US005804528A

United States Patent [19]

Aoki et al.

[11] Patent Number: 5,804,528

[45] Date of Patent: Sep. 8, 1998

[54] THERMOSENSITIVE RECORDING MATERIAL WITH A HIGH FOG RESISTANCE

[75] Inventors: Yasuyuki Aoki; Tomotsugu Takahashi; Akira Maeta, all of Tokyo; Rie Harunaga, Shiki; Haruo Omura, Inzai; Satoshi Fukui, Tokyo, all of Japan

[73] Assignee: Oji Paper Co., Ltd., Tokyo, Japan

[21] Appl. No.: 752,628

[22] Filed: Nov. 19, 1996

[30] Foreign Application Priority Data

| | | | |
|---|---|---|---|
| Nov. 20, 1995 | [JP] | Japan | 7-323536 |
| Mar. 27, 1996 | [JP] | Japan | 8-095873 |
| Apr. 25, 1996 | [JP] | Japan | 8-105715 |

[51] Int. Cl.[6] ..... B41M 5/34; B41M 5/36

[52] U.S. Cl. ..... 503/204; 427/150; 427/152; 503/207; 503/208; 503/213; 503/214

[58] Field of Search ..... 427/150–152; 503/204, 207, 208, 213, 214

[56] References Cited

U.S. PATENT DOCUMENTS

| | | | |
|---|---|---|---|
| 3,843,384 | 10/1974 | Adachi et al. | 503/204 |
| 3,895,173 | 7/1975 | Adachi | 503/204 |
| 5,155,087 | 10/1992 | Matsushita et al. | 503/217 |

FOREIGN PATENT DOCUMENTS

| | | | |
|---|---|---|---|
| 48-8251 | 2/1973 | Japan . | |
| 48-86543 | 11/1973 | Japan . | |
| 49-70 | 1/1974 | Japan | 503/204 |
| 49-27708 | 7/1974 | Japan | 503/204 |
| 51-145239 | 12/1976 | Japan | 503/204 |
| 54-136915 | 10/1979 | Japan | 503/215 |
| 54-139741 | 10/1979 | Japan | 503/205 |
| 57-12695 | 1/1982 | Japan | 503/215 |
| 59-214691 | 12/1984 | Japan | 503/215 |
| 60-242093 | 12/1985 | Japan | 503/204 |
| 60-244594 | 12/1985 | Japan | 503/215 |
| 61-86283 | 5/1986 | Japan | 503/215 |
| 61-182983 | 8/1986 | Japan | 503/226 |
| 63-31788 | 2/1988 | Japan | 503/215 |
| 2-80287 | 3/1990 | Japan | 503/216 |
| 4-101885 | 4/1992 | Japan | 503/213 |
| 6-227144 | 8/1994 | Japan | 503/207 |
| 93/08030 | 4/1993 | WIPO | 503/207 |

*Primary Examiner*—Bruce H. Hess
*Attorney, Agent, or Firm*—Nikaido, Marmelstein, Murray & Oram LLP

[57] ABSTRACT

A thermosensitive recording material with a high resistance to fogging has a thermosensitive colored image-forming layer formed on a support and includes at least one colorless dye precursor, a color-developing agent and a binder, the dye precursor being contained in a plurality of fine solid composite particles prepared by dissolving a solute including the dye precursor in a solvent which includes a polymerization component including a polyvalent isocyanate compound; emulsifying the resultant solution in an aqueous medium; and subjecting the aqueous emulsion to a polymerization reaction to thereby form the fine solid composite particles in which the dye precursor is solid-dissolved in a solid thermoplastic resin matrix formed from a resultant polyurea or polyurethane polyurea resin.

21 Claims, 2 Drawing Sheets

THERMOSENSITIVE RECORDING MATERIAL WITH A HIGH FOG RESISTANCE

BACKGROUND OF THE INVENTION

1. Field of the Invention

The present invention relates to a thermosensitive recording material with a high fog resistance. More particularly, the present invention relates to a thermosensitive recording material having a thermosensitive colored image-forming layer which contains a plurality of fine solid composite particles comprising a substantially colorless dye precursor dissolved in a solid thermoplastic resinous matrix, and exhibiting a high resistance to fogging derived from pressure, friction and scratching and a high storage stability.

Also, the thermosensitive recording material of the present invention can record thereon colored images having an excellent clarity, a high color density and a high resistance to fading.

2. Description of Related Art

A thermosensitive recording material for recording thereon colored images by utilizing a reaction of a dye precursor with a color-developing agent reactive with the dye-precursor upon heating to thereby cause both the dye precursor and the color-developing agent to be melted and brought into contact with each other so as to develop a color, is well known. This type of thermosensitive recording material is advantageous in that the colored images can be easily formed only by heating, the recording apparatus is relatively compact and can be easily maintained, and the recording cost is relatively low, and thus widely useful as an information-recording medium for various outputs and printers used with, for example, facsimile machines, word processors, computers and other recorders.

However, the conventional thermosensitive recording material using the dye precursor and the color-developing agent which are in the form of solid particles is disadvantageous in that the resultant color images may disappear under influence of heat and/or moisture.

It is known to solve the above-mentioned disadvantages of the conventional thermosensitive recording material by utilizing microcapsules in which cores comprising a solution of a dye precursor in an oily solvent are surrounded and sealed by resinous shells. For example, Japanese Examined Patent Publication Nos. 4-4960, 4-37796, 4-37797 and 5-63315 disclose the above-mentioned type of thermosensitive recording materials.

Also, the microcapsules containing therein a solution of a dye precursor in an oily liquid, as cores have been utilized for pressure-sensitive duplicating sheets and are disclosed, for example, in Japanese Unexamined Patent Publication No. 60-49119 and Japanese Unexamined Patent Publication No. 63-31788.

Various methods for producing a microcapsule composed of a shell consisting of a resinous material and a core surrounded and shield by the shell and consisting of a solution of a functional material in an oily solvent are known from a number of publications, for examples, "New Development of Fine Polymer Particles as a Functional Material" published by Toray Research Center on 1994, Masumi Koishi, "Fine Particle Design" published by Kogyochosa Kai on 1987 and Tamotsu Kondo "Microcapsules—Function and Application" published by Nihon Kikaku Kyokai on 1991.

The methods of producing the fine polymer particles are briefly classified into a polymerization granulation method in which the granulation of a resinous material is carried out during the polymerization of the resinous material, and a dispersion granulation method in which fine solid particles of a resinous material are formed from a fine particles of a solution of the resinous material. The methods of producing microcapsules can be generally classified into the two methods as mentioned above.

The above-mentioned thermosensitive recording materials containing the conventional microcapsules of the solution of the dye precursor in an oily solvent are disadvantageous in that the microcapsules easily collapse under pressure, friction or scratching so as to generate foggy coloration on the recording material surface or to stain the background of the colored images during storage. To prevent the breakage of the dye precursor-containing microcapsules, it is effective to make the shells of the microcapsules thicker. The thickened shells cause the resultant thermosensitive recording material to exhibit a reduced color-forming sensitivity.

Another type of dye precursor-containing microcapsules having resinous shells and hollow core spaces formed inside of the shells and containing the dye precursor in the state of a solid deposited on the inside surfaces of the shells are disclosed, for example, in Japanese Unexamined Patent Publication No. 4-101885. This type of microcapsules are prepared by encapsulating emulsified fine liquid particles of a solution of a dye precursor in a solvent with a resinous material while evaporating away the solvent. Accordingly, the deposited dye precursor is confined in the hollow core spaces of the microcapsules. This type of hollow microcapsules has a low resistance to pressure or friction and are easily broken under pressure so as to stain the background of the colored images on the recording surface. If the shells of the microcapsules are thickened, the resultant thermosensitive recording material exhibits a reduced color-forming sensitivity. Therefore, it is significantly difficult to obtain both the high fog resistance and the high sensitivity. Also, in the preparation of the microcapsules, the volatile solvent for the dye precursor is evaporating away during the formation of the resinous shells, the resultant resinous shells are defective and incompletely shield the dye precursor contained in the hollow core spaces from the outside atmosphere. Accordingly, the resultant thermosensitive recording material is unsatisfactory in storage stability before and after printing.

With the expansion of the scope of application of the thermosensitive recording materials, the performances required to the thermosensitive recording materials are diversified and varied. For example, there is strong requirements for providing a new thermosensitive recording material having an enhanced sensitivity, or an improved stability of colored image or a capability of recording multi-colored images. The multi-colored image recording material is advantageous in that particular letters and pictures to be emphasized can be clearly and definitely illustrated in a color different from that of the other images, and thus currently, is strongly demanded to be realized for practical use.

For this demand, various attempts have been made to provide the thermosensitive multicolored image recording material including two or more color-forming systems capable of forming colored images different in color from each other, by utilizing a difference in necessary temperature or in necessary amount of heat energy necessary to form the colored images between the color-forming systems from one another. Generally, the thermosensitive multicolored image recording material comprises a support layer, a high temperature colored image-forming layer formed on the support layer and a low temperature colored image-forming layer formed on the high temperature colored image forming layer, and are broadly classified into two types, namely a color-disappearance type and a color-addition type.

The color-disappearance type thermosensitive multicolored image recording materials are disclosed, for example, by Japanese Unexamined Patent Publication No. 2-80287 and Japanese Examined Patent Publication Nos. 50-17865, 57-14320. In this type of recording material having a high temperature colored image-forming under layer and a low temperature colored image-forming upper layer, when a colored image-forming operation at a lower temperature is applied, the colored images are developed only in the low temperature colored image-forming upper layer, and when another colored image-forming operation is applied at a higher temperature, a color-disappearing agent contained in the recording material is activated and removes the colored images in the low temperature colored image-forming upper layer and the other colored images are formed only in the high temperature colored image-forming under layer. This color-disappearance type multicolored image recording system is advantageous in that the hue of the image to be recorded can be freely chosen and disadvantageous in that the color-disappearing agent must be contained in a large content in the recording material to record clear colored images in the upper layer, the large content of the color-disappearing agent may cause the colored images formed in the upper layer to disappear during the storage of the colored images, and the activation of the color-disappearing agent needs a certain amount of energy in addition to the amount of energy necessary to the colored image formation, and thus the thermal head may be overloaded. Also, this type of multicolored image recording material is not always satisfactory in reliability of the colored image recording and sensitivity of the recording material.

Some examples of the color-addition type multicolored image-recording system are disclosed in Japanese Examined Patent Publication Nos. 49-27708 and 51-19989 and Japanese Unexamined Patent Publication No. 51-146239. This type of multicolored image-recording material has two or more thermosensitive colored image-forming layers laminated on each other and capable of forming therein colored images different in color and distinguishable from each other, by applying heat energy in different amounts from each other to the colored image-forming layers. In this system, when a recording (colored image-forming) operation is applied at a lower temperature, the colored images are formed only in the upper layer, and when a recording operation is applied at a higher temperature, the colored images are formed in both the upper and under layers and the visible colored images has a mixed color of the color in the upper layer with the color in the under layer. Therefore, this color-addition system is appropriate to form black colored images in the under layer by the higher temperature recording operation. In the color-addition type multicolored image-recording materials, since no color-disappearing agent is used, the resultant recorded colored images have a higher storage stability and can be produced with a lower cost than those of the color-disappearance type. Also, since no additional heat for melting the color-disappearing agent is necessary, the colored images in the high temperature colored image-forming under layer can be formed with a smaller amount of heat energy than that in the color-disappearance type.

Nevertheless, the conventional color-addition type multicolored image recording material is disadvantageous in that if the lower temperature colored image forming operation is applied with an excessive amount of heat energy, the under layer may be color-developed and the visible color of the resultant colored images in the upper layer is mixed with the developed color in the under layer and thus the resultant visible colored images may become unclear.

Further, Japanese Unexamined Patent Publication No. 56-99097 discloses a thermosensitive multicolored image recording material having two or more types of dye precursors different in developed color from each other and contained in one and the same colored image-forming layer. In this type of the multi-colored image-recording material, when a colored image-forming operation is applied at a lower temperature to color-develop type of dye precursor, it is inavoidable to cause at least a portion of the other type or types of dye precursor to be undesirably color-developed, and the targent colored images to be mixed in color with the color derived from the other dye precursors.

As mentioned above, it is known that microcapsules are utilized for a thermosensitive recording material. For example, Japanese Examined Patent Publication No. 49-70 discloses a method of producing microcapsules by encapsulating a solvent which is in the state of a liquid at room temperature. Also, Japanese Unexamined Patent Publication Nos. 57-12695 and 59-214691 disclose microcapsules containing, as a core component, a color-forming component.

Further, Japanese Examined Patent Publication No. 4-4960 and Japanese Unexamined Patent Publication No. 4-101885 disclose a multicolored image-recording material containing two or more types of microcapsules different in glass transition temperature of the shell-forming resinous material and in color developed from the dye precursors, from each other. However, when the two or more types of dye precursors different in developed color from each other are separately capsulated with the resinous materials different in glass transition temperature from each other, the resultant microcapsules respectively exhibit a reduced color-developing sensitivity and thus they are difficult to classify with respect to the sensitivity thereof. Therefore, it is difficult to separately color-develop the two or more types of microcapsules and the resultant visible colored images have a mixed color.

Further, the microcapsules contain the dye precursors in the state of a solution in an oily solvent, and thus easily collapse under pressure or friction and an undesirable foggy coloration occurs in the colored image-forming layer.

SUMMARY OF THE INVENTION

An object of the present invention is to provide a thermosensitive recording material having a high whiteness and a high fog resistance.

Another object of the present invention is to provide a thermosensitive recording material capable of recording thereon colored images having an enhanced resistance to fading and a high clarity.

The thermosensitive recording material of the present invention includes a thermosensitive single colored image-recording material and a thermosensitive multi-colored image-recording material.

The thermosensitive multi-colored image-recording material of the present invention can record thereon multi-colored images having a high clarity and color brightness without color-mixing.

The above-mentioned objects can be attained by the thermosensitive recording material of the present invention which comprises:

a support, and a thermosensitive colored image-forming layer formed on a surface of the support and comprising at least one substantially colorless dye precursor, a color-developing agent reactive with the dye precursor upon heating to thereby develop a color, and a binder, the dye precursor in the thermosensitive colored image-forming layer being present in a plurality of fine solid composite particles which have been prepared by dissolving a solute comprising the dye precursor in a solvent comprising a polymerization component comprising a polyvalent isocyanate compound; emulsifying the resultant solution in an aqueous medium; and subjecting the resultant aqueous emulsion to a polymerization reaction of the polymerization component; and in which the dye precursor is dissolved in a solid thermoplastic resinous matrix consisting of a resultant polyurea or polyurethane polyurea resin.

In the thermosensitive recording material of the present invention, the solute may further contain at least one fusible organic compound, for example, thermosensitizing compounds, UV-ray-absorbing compounds or antioxidant compounds, and thus the fusible organic compound may be contained together with the dye precursor in the solid thermoplastic resinous matrix of the fine composite particles.

In the thermosensitive recording material of the present invention, the polymerization component preferably comprises at least one member selected from polyvalent isocyanate compounds, mixtures and addition reaction products of polyvalent isocyanate compounds with polyols, and biuret compounds and isocyanurate compounds of polyvalent isocyanate compounds.

In the thermosensitive recording material of the present invention, preferably the polymerization component comprises at least one member selected from the group consisting of hexamethylene diisocyanate, addition reaction products of hexamethylene diisocyanate with trimethylolpropane, biuret compounds of hexamethylene diisocyanate, isocyanurate compounds of hexamethylene diisocyanate, dicyclohexylmethane-4,4'-diisocyanate, 5-isocyanato-1-(isocyanatomethyl)-1,3,3-trimethylcyclohexane, tetramethylxylene diisocyanate and 1,3-bis(isocyanatomethyl)cyclohexane.

In the thermosensitive recording material of the present invention, wherein the dye precursor-containing fine composite particles may be non-porous dense particles, porous particles, or hollow particles.

In the thermosensitive recording material of the present invention, the solvent preferably consists of the polymerization component alone.

In the thermosensitive recording material of the present invention, optionally the solvent comprises, in addition to the polymerization component, a non-reactive, hydrophobic liquid substance having a boiling temperature of 20° to 100° C., for example, butyl chloride, ethylene chloride, propyl chloride, methylene chloride, ethyl acetate or methyl acetate, and the resultant aqueous emulsion is heat-treated at a temperature of 20° to 55° C. to evaporate away the liquid substance from the aqueous emulsion, before the polymerization reaction.

In the thermosensitive recording material of the present invention, optionally the thermosensitive colored image-forming layer further comprises at least one additional dye precursor different in developed color from the dye precursor contained in the fine solid composite particles, the additional dye precursor being in the form of a plurality of fine solid particles and thus is capable of recording therein two or more different colored images.

In the thermosensitive two or more different colored image-recording material of the present invention as mentioned above, preferably the dye precursor contained in the fine solid composite particles is capable of developing a black color.

In the thermosensitive recording material of the present invention, optionally the thermosensitive colored image-forming layer contains two or more sorts of the dye precursor-containing solid composite particles different from each other in developed color of the dye precursors and in developing temperature of the solid composite particles, and thus is capable of recording therein two or more different colored images.

In the thermosensitive multi-colored image-recording material of the present invention as mentioned above, optionally, the thermosensitive colored image-forming layer further contains at least one additional dye precursor in the form of a fine solid particles, different in developed color from those of the dye precursors contained in the fine solid composite particles, and thus is capable of recording therein three or more different colored images.

The thermosensitive recording material of the present invention may further comprise an additional thermosensitive colored image-forming layer formed on the thermosensitive colored image-forming layer or between the thermosensitive colored image-forming layer and the substrate, and comprising a substantially colorless dye precursor different in developed color from those of the dye precursor(s) contained in the thermosensitive colored image-forming layer, and thus being capable of forming therein colored images different in color from those of the thermosensitive colored image-forming layer.

DESCRIPTION OF THE PREFERRED EMBODIMENTS

Figure 1:
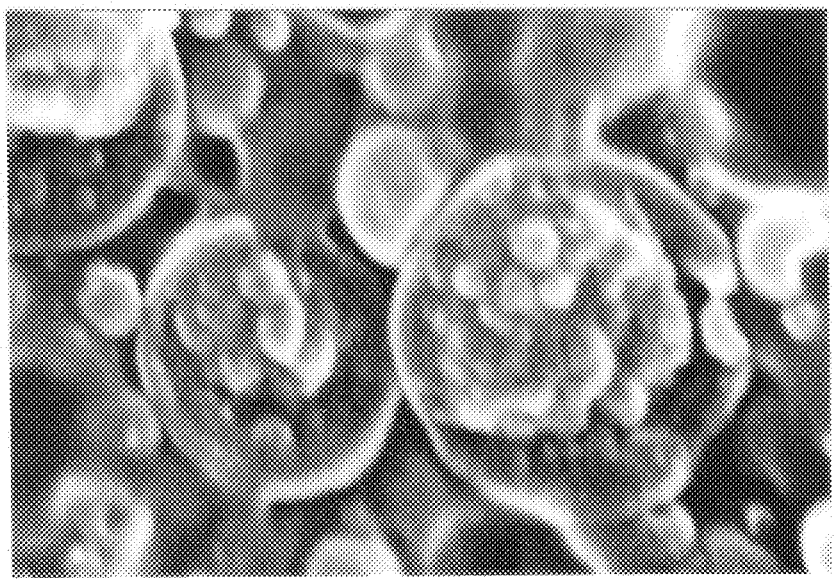
FIG. 1 is an electron microscope cross-sectional view of dye precursor-containing fine solid composite particles of Example 1 in accordance with the present invention.

The thermosensitive recording material of the present invention comprises a thermosensitive colored image-forming layer formed on a surface of a support and comprising at least one substantially colorless dye precursor, a color-developing agent reactive with the dye precursor upon heating to thereby develop a color, and a binder.

In the present invention, the at least one dye precursor contained in the thermosensitive colored image-forming layer is present in a plurality of fine solid composite particles. The fine solid composite particles are ones prepared by dissolving a solute comprising the at least one dye precursor in a solvent comprising a polymerization component which comprises a polyvalent isocyanate compound; emulsifying the resultant solution in an aqueous medium; and subjecting the resultant aqueous emulsion to a polymerization reaction of the polymerization component. As a result of the polymerization reaction, the resultant fine solid composite particles contain the dye precursor in the state of a solid solution in a solid thermoplastic resinous matrix consisting of a resultant polyurea or polyurethane polyurea resin, and substantially no liquid.

As mentioned above, the dye precursor-containing fine solid composite particles are substantially free from a liquid such as an organic solvent, and thus have a high mechanical strength. In the thermosensitive recording material of the present invention, the thermosensitive colored image-forming layer containing the dye precursor-dissolved fine solid composite particles exhibit an enhanced resistance to pressure and friction. Also, the thermosensitive colored image-forming layer containing the dye precursor-dissolved fine solid composite particles exhibits a higher storage stability against undesirable fogging and a higher durability of the colored images formed thereon than those of the thermosensitive colored image-forming layer containing conventional dye precursor-containing microcapsules which have been prepared by using an organic solvent for the dye precursor.

The fine solid composite particles usable for the present invention comprise a solid thermoplastic resinous matrix consisting of a polyurea resin or a polyurethane polyurea resin and a dye precursor in the state of a solid solution in the resinous matrix and are substantially free from a liquid substance, for example, an organic solvent for the dye precursor. The fine solid composite particles may be in the form a non-porous dense solid particles, porous particles or hollow particles.

The non-porous dense solid composite particles have substantially no pores or hollow space. The porous composite particles have a plurality of pores distributed in a solid matrix. The hollow composite particles each have a core hollow space surrounded by a solid shell.

When a cross-section of an individual composite particle is observed by an electron microscope, at a magnification of 500 to 10,000, and no pores or hollow space are found in the cross-section, the composite particle is referred to as a non-porous dense particle. When a plurality of pores having a size of ⅕ or less of the size of the individual composite particle are found, the composite particle is referred to as a porous composite particle. In the porous dense composite particles usable for the present invention, the pores are connected to each other and to the outside of the composite particles through a plurality of capillaries. In the electron microscopic observation, when a core hollow having a size of more than ⅕ of the size of the composite particles is found in each composite particle, the composite particle is referred to as a hollow composite particle.

When a mass of fine solid composite particles include 70% or more of non-porous solid composite particles, they are referred to a mass of non-porous dense composite particles.

Also, when a mass of fine solid composite particles include 70% or more of porous composite particles, they are referred to a mass of porous solid composite particles. Further, a mass of the fine solid composite particles including hollow composite particles in a proportion of 70% or more are referred to as a mass of fine hollow composite particles.

In the hollow composite particles, the core hollow preferably have a size of less than ⅓ of the size of the particles. If the size of the core hollow is 1/1 or more of the particle size, the resultant hollow composite particles may exhibit an unsatisfactory resistance to collapse or breakage.

Preferably, the fine solid composite particles usable for the present invention are in the form of porous particles wherein a plurality of fine pores are distributed in the resinous matrix containing the dye precursor in the state of a solid solution in the resinous matrix. More preferably, the fine solid composite particles are in the form of non-porous, non-hollow particles which are substantially free from pores or a hollow. The presence of substantially no pores can be confirmed by an electron microscopic observation of the cross sections of the particles.

If the fine solid composite particles contains a liquid or the core hollow space has a size of ⅓ or more of the size of the fine solid composite particles, the resultant fine solid composite particles in the thermosensitive colored image-forming layer may be easily collapsed when the thermosensitive colored image-forming layer or a protective layer formed on the colored image-forming layer is subjected to a smoothing treatment by a calendar, to generate a fogging phenomenon and to reduce the whiteness of the recording material. As mentioned above, the pores or core hollow can be easily found by the electron microscopic observation of the cross section of the composite particles.

The fine solid composite particles usable for the present invention can be prepared by dissolving a solute comprising the dye precursor in a solvent comprising, preferably consisting essentially of, more preferably consisting of, a polymerization component comprising a polyvalent isocyanate compound; emulsifying the resultant solution in an aqueous medium to form fine liquid particles, and subjecting the resultant aqueous emulsion to a polymerization reaction of the polymerization component to provide a plurality of fine solid composite particles comprising the dye precursor which is solid-dissolved in a solid thermoplastic resinous matrix consisting of a polyurea or polyurethane polyurea resin, the fine solid composite particles being substantially free from a liquid.

In an embodiment of the preparation procedure of the fine solid composite particles, a solute comprising the dye precursor is dissolved in a polyvalent isocyanate compound alone. The solute optionally comprises, in addition to the dye precursor, at least one fusible organic compound. The fusible organic compound is also solid-dissolved or dispersed in the thermoplastic resinous matrix of the fine composite particles. The fusible organic compound has a melting temperature of 40° to 150° C. and a boiling temperature of 200° C. or more.

The preparation of the dye-precursor-containing solution is carried out preferably at a temperature of 60° to 200° C. If the dissolving temperature is lower than 60° C., the dye-precursor may not be fully dissolved in the solvent (or the polymerization component) and thus in the resultant fine solid composite particles, the dye precursor may not be fully solid-dissolved in the resultant thermoplastic resinous matrix, and may not be fully isolated from the color-developing agent through the resinous matrix. Also, if the dissolving temperature is higher than 200° C., the polymerization component may be unstabilized and may not fully dissolve the dye precursor, and in the resultant fine solid composite particles, the dye precursor may not be fully solid-dissolved in the resultant resinous matrix.

Next, the resultant solution is emulsified in an aqueous medium into a plurality of fine liquid particles. The aqueous medium preferably contains an emulsifying surfactant or a protective colloid substance, for example, polyvinyl alcohol. To the resultant aqueous emulsion, an additional polymerization component, for example, a water-soluble polyamine compound, is optionally added.

The aqueous emulsion is subjected to a polymerization reaction procedure for the polymerization component and optionally the additional polymerization component at a temperature of 40° C. or more, preferably 40° C. to 130° C. under the ambient air pressure or a raised pressure to polymerize the polymerization component comprising the polyvalent isocyanate compound and optionally the water-soluble polyamine compound into a polyurea resin or a polyurethane polyurea resin, and thereby to provide a thermoplastic resinous matrix. The polymerization temperature is preferably lower than the boiling temperature of the polymerization component. In the resultant fine solid composite particles, it is assumed that the dye precursor and optionally the fusible organic compound are solid-dissolved in the form of individual molecules in the resultant thermoplastic resinous matrix. Also, the resultant fine solid composite particles contain substantially no liquid. In this embodiment, no evaporation of the polymerization system occurs and thus the resultant thermoplastic resinous matrix is dense and the dye precursor is fully isolated by the dense resinous matrix from the color-developing agent.

The thermosensitivity of the dye precursor can be enhanced by adding the fusible organic compound having a melting temperature of 40° to 150° C. and a boiling temperature of 200° C. or more to the fine solid composite particles.

In another embodiment of the preparation procedure of the fine solid composite particles usable for the present invention, a solute comprising a dye precursor is dissolved in a solvent comprising a polymerization component comprising a polyvalent isocyanate compound and optionally a polyol compound and a polyamine compound for producing a polyurea resin or a polyurethane polyurea resin, and a volatile organic compound capable of dissolving the solute therein, having a boiling point of 20° to 100° C. and being insoluble or difficult to dissolve in water. The resultant solution is emulsified in an aqueous medium. The aqueous medium preferably contains an emulsifying surfactant and/or a protective colloid substance, for example, polyvinyl alcohol. The emulsifying temperature is lower than the boiling temperature of the solvent, preferably by 5° C. to 45° C. After the emulsifying step, if necessary, an additional polymerization component, for example, a water-soluble polyamine compound is added to the emulsion.

The aqueous emulsion is subjected to an evaporation treatment at a temperature of 20° to 55° C. to completely evaporate away the volatile organic compound from the emulsified solution particles. The remaining aqueous emulsion is then subjected to a polymerization reaction procedure at a temperature of 60° C. to 100° C. to polymerize the polymerization component into a polyurea resin or a polyurethane polyurea resin, and to provide fine solid composite particles wherein the solute is solid-dissolved in the sate of individual molecules in the solid resinous matrix, namely the polyurea or polyurethane polyurea resin.

The volatile organic compounds usable as a solvent for the dye precursor and the polymerization component preferably have a boiling temperature of 20° to 100° C., more preferably 20° to 80° C. and are non-compatible with water (insoluble in or difficult to dissolve in water). The hydrophobic volatile organic compounds are preferably selected from butyl chloride (B.P.=78° C.), ethylidene chloride (B.P.=57° C.), propyl chloride (B.P.=46° C.), methylene chloride (B.P.=42° C.), ethyl acetate (B.P.=77° C.) and methyl acetate (B.P.=57° C.). Water-compatible, volatile organic compounds, for example, acetone (B.P.=56° C.), and methyl alcohol (B.P.=65° C.) are unusable for the present invention, because the use of the water-compatible organic compound causes the resultant aqueous emulsion to be unstable.

The resultant fine solid composite particles from the above-mentioned embodiment are in the form of non-porous dense particles, porous particles or hollow particles, and contain substantially no liquid. The form of the fine solid composite particles can be established by controlling the type and amount of the polymerization component, the type and amount of the volatile organic compound, the process conditions, for example, temperature and agitation conditions of the emulsification and polymerization procedures, the type of emulsifying machine, the size of the emulsified solution particles, the form and size of opening portions of the emulsification, evaporation treatment and polymerization vessels. Especially, the form of the fine solid composite particles is responsive to the reactivity of the polymerization component and the volatility of the volatile organic component. Usually, the hollow particles can be obtained by using a polyisocyanate compound having a high reactivity and a high capability of polymerizing at a high polymerization rate during the evaporation treatment. Also, where the additional polymerization component, for example, a polyol and/or polyamine compound is added to the polyvalent isocyanate-containing solution, the resultant polymerization component polymerizes not only at the interfaces between the solution particles and the aqueous medium but also in the inside of the solution particles, and thus the resultant fine solid composite particles are in the form of porous particles or non-porous dense particles. Where the volatile organic compound is contained in the solution, the higher the boiling temperature of the volatile organic compound and the larger the content of the volatile organic compound in the solution, the higher the possibility of the formation of the hollow particles. Accordingly, where the volatile organic compound is selected from those having a boiling temperature of 20° to 100° C., the evaporation treatment for the volatile organic compound in the emulsified solution particles is carried out while agitating the aqueous emulsion at a relatively low temperature of 20° to 55° C. for a long time, for example, 2 to 48 hours, the resultant fine solid composite particles are in the form of non-porous dense particles or porous particles.

For example, a dye precursor is dissolved in a solvent consisting of an isocyanurate compound of hexamethylene diisocyanate and methylene chloride with a boiling point of 40° C., and the resultant solution is emulsified in an aqueous solution of polyvinyl alcohol at a temperature of 20° C. while agitating the mixture. The resultant aqueous emulsion is evaporation-treated at a temperature of 35° to 45° C. for 2 hours or more, preferably 5 hours or more, to completely evaporate methylene chloride from the emulsified solution particles and to convert the aqueous emulsion to an aqueous dispersion. The aqueous dispersion is heated to a temperature of 60° to 100° C., preferably 80° to 95° C. and then maintained at this temperature for one hour or more, preferably 2 hours or more to polymerize the polymerization component into a polyurea resin or a polyurethane polyurea resin. The resultant fine solid composite particles are in the form of non-porous dense particles. In the above-mentioned procedures, when the evaporation treatment for the aqueous emulsion is carried out at a temperature of 35° C. for one hour and then the polymerization procedure is carried out, the resultant fine solid composite particles are in the form of porous particles. The above-mentioned non-porous dense particles and porous particles contain substantially no liquid.

In the above-mentioned process conditions for the preparation of the porous composite particles, if the isocyanurate compound of hexamethylene diisocyanate is replaced by 4,4'-diphenyl methane diisocyanate which exhibits a high reactivity even at a low temperature, the resultant fine solid composite particles may be in the form of hollow particles. Namely, in this case, during the evaporation treatment, the reactive 4,4'-diphenylmethane diisocyanate begins an interfacial polymerization at the interfaces between the aqueous medium and the emulsified solution particles which still contain the volatile organic compound, to thereby form resinous shells surrounding the solution particles, and thereafter the volatile organic compound is evaporated away from the emulsified solution particles through the surrounding resinous shells, to leave the dye precursor on the inside surfaces of the resinous shells. The remaining dye precursor is substantially not contained inside the resinous shell. The resultant particles should be definitely distinguished from the specific fine solid composite particles usable for the present invention.

Accordingly, in the preparation of the fine solid composite particles usable for the present invention, the evaporation treatment for the volatile organic compound in the emulsified solution particles should be carried out while inhibiting the polymerization of the polymerization component. When the evaporation treatment is effected without the polymerization of the polymerization component, the emulsified solution particles are converted to porous solid particles or non-porous dense particles in which the dye precursor is solid-dissolved in the polymerization component. These solid particles can be converted by the polymerization procedure to the fine solid composite particles (dense or porous) in which the dye precursor is solid-dissolved in the resultant polyurea or polyurethane polyurea resin matrix. With respect to the polymerization of the polyvalent isocyanate compound, it is assumed that carbon dioxide produced from the reaction of the polyvalent isocyanate compound with water influences the form or structure of the resultant fine solid composite particles.

The dye precursor usable for the present invention can be selected from at least one leuco compounds of triaryl, diphenylmethane, thiazine, spiropyran, lactam and fluoran compounds. Examples of black-color-forming dye precursor compounds usable for the present invention are 3-pyrrolidine-6-methyl-7-anilinofluoran, 3-diethylamine-7-(m-trifluoromethylanilino)fluoran, 3-(N-isoamyl-N-ethylamino)-7-(o-chloroanilino)fluoran, 3-(N-ethyl-p-toluidino)-6-methyl-7-anilinofluoran, 3-(N-ethyl-N-2-tetrahydrofurfurylamino)-6-methyl-7-anilinofluoran, 3-diethylamino-6-chloro-7-anilinofluoran, 3-di(n-butyl)amino-6-methyl-7-anilinofluoran, 3-di(n-amyl)amino-6-methyl-7-anilinofluoran, 3-(N-isoamyl-N-ethylamino)-6-methyl-7-anilinofluoran, 3-(N-n-hexyl-N-ethylamino)-6-methyl-7-anilinofluoran, 3-[N-(3-ethoxypropyl)-N-ethylamino)-6-methyl-7-anilinofluoran, 3-[N-(3-ethoxypropyl)-N-methylamino]-6-methyl-7-anilinofluoran, 3-diethylamino-7-(2-chloroanilino)fluoran, 3-di(n-butyl)amino-7-(2-chloroanilino)fluoran, 3-diethylamino-6-methyl-7-anilinofluoran, 3-diethylamino-6-methyl-7-(2,6-dimethylanilino)fluoran, 3-diethylamino-6-methyl-7-(2,4-dimethylanilino)fluorane, 2,4-dimethyl-6-(4-dimethylaminoanilino)fluoran, and 3-(N-cyclohexyl-N-methylamino)-6-methyl-7-anilinofluoran. These compounds may be employed alone or in a mixture of two or more thereof.

Among the above-mentioned black color-forming dye precursors usable for the present invention, at least one selected from 3-di-n-amylamino-6-methyl-7-anilinofluoran, 3-diethylamino-6-methyl-7-(2,6-dimethylanilino)fluoran and 2,4-dimethyl-6-(4-dimethylaminoanilino)fluoran which have an excellent light fastness, are preferably used.

The dye precursors for forming red, reddish violet and orange colors include 3,6-bis(diethylamino)fluorane-γ-anilinolactam, 3,6-bis(diethylamino)fluoran-γ-(p-nitro)anilinolactam, 3,6-bis(diethylamino)fluoran-γ-(o-chloro)anilinolactam, 3-dimethylamino-7-bromofluoran, 3-diethylaminofluoran, 3-diethylamino-6-methylfluoran, 3-diethylamino-7-methylfluoran, 3-diethylamino-7-chlorofluoran, 3-diethylamino-7-bromofluoran, 3-diethylamino-7,8-benzofluoran, 3-diethylamino-6,8-dimethylfluoran, 3-diethylamino-6-methyl-7-chlorofluoran, 3-diethylamino-7-tert-butylfluoran, 3-(N-ethyl-N-tolylamino)-7-methylfluoran, 3-(N-ethyl-N-tolylamino)-7-ethylfluoran, 3-(N-ethyl-N-isobutylamino)-6-methyl-7-chlorofluoran, and 3-(N-ethyl-N-isoamylamino)-7,8-benzofluoran. Further, the dye precursors for forming red, reddish violet and orange colors include 3-cyclohexylamino-6-chlorofluoran, 3-di-n-butylamino-6-methyl-7-bromofluoran, 3-di-n-butylamino-7,8-benzofluoran, 3-tolylamino-7-methylfluoran, 3-tolylamino-7-ethylfluoran, 2-(N-acetylanilino)-3-methyl-6-di-n-butylaminofluoran, 2-(N-propionylanilino)-3-methyl-6-di-n-butylaminofluoran, 2-(N-benzoylanilino)-3-methyl-6-di-n-butylaminofluoran, 2-(N-carbobutoxyanilino)-3-methyl-6-di-n-butylaminofluoran, 2-(N-phormylanilino)-3-methyl-6-di-n-butylaminofluoran, 2-(N-benzylanilino)-3-methyl-6-di-n-butylaminofluoran, 2-(N-allylanilino)-3-methyl-6-di-n-butylaminofluoran, and 2-(N-methylanilino)-3-methyl-6-di-n-butylaminofluoran.

Other dye precursors for forming red, reddish violet and orange colors include 3,3'-bis(1-n-butyl-2-methylindole-3-yl)phthalide, 3,3'-bis(1-ethyl-2-methylindole-3-yl)phthalide, 3,3'-bis(1-n-octyl-2-methylindole-3-yl)phthalide, 7-(N-ethyl-N-isoamylamino)-3-methyl-1-phenylspiro[(1,4-dihydrochromeno[2,3-c]pyrazole)-4,3'-phthalide], 7-(N-ethyl-N-isoamylamino)-3-methyl-1-p-methylphenylspiro[(1,4-dihydrochromeno[2,3-c]pyrazole)-4,3'-phthalide] and 7-(N-ethyl-N-n-hexylamino)-3-methyl-1-phenylspiro[(1,4-dihydrochromeno[2,3 -c]pyrazole)-4,3'-phthalide].

Where, as a red color-forming dye precursor, 3-diethylamino-7-chlorofluoran or 3-diethylamino-6-methyl-7-chlorofluoran is used, a complementary color-forming dye precursor, which forms a color different from that of the above-mentioned dye precursor, may be mixed with the above-mentioned dye precursor. For example, the above-mentioned dye precursor may be mixed with a small amount of 3,3'-bis(1-n-butyl-2-methylindole-3-yl)phthalide or 3,3'-bis(1-ethyl-2-methylindole-3-yl)phthalide which forms a reddish color, to enhance the reddish color tone of the developed color.

The dye precursors usable for the present invention for forming blue color include 3,3-bis(p-dimethylaminophenyl)-6-di-methylaminophthalide, 3-(4-diethylamino-2-methylphenyl-3-(4-dimethylaminophenyl)-6-dimethylaminophthalide, 3-(1-ethyl-2-methylindole-3-yl)-3-(4-diethylaminophenyl)phthalide, 3-(1-ethyl-2-methylindole-3-yl)-3-(2-methyl-4-diethylaminophenyl)-4-azaphthalide, 3-(1-ethyl-2-methylindole-3-yl)-3-(2-ethoxy-4-diethylaminophenyl)-4-azaphthalide, 3-(1-ethyl-2-methylindole-3-yl)-3-(2-n-hexyloxy-4-diethylaminophenol)-4-azaphthalide, and 3-diphenylamino-6-diphenylaminofluoran.

The dye precursors usable for the present invention for forming green color, include 3-(N-ethyl-N-n-hexylamino)-7-anilinofluoran, 3-diethylamino-7-dibenzylaminofluoran, 3,3-bis(4-diethylamino-2-ethoxyphenyl)-4-azaphthalide, 3-(N-ethyl-N-p-tolylamino]-7-(N-phenyl-N-methylamino)fluoran, 3-[p-(p-anilinoanilino)anilino)-6-methyl-7-chlorofluoran and 3,6-bis(dimethylamino)fluorene-9-spiro-3'-(6'-dimethylamino)phthalide.

The dye precursors usable for the present invention for forming yellow color include 3,6-dimethoxyfluoran and 1-(4-n-dodecyloxy-3-methoxyphenyl)-2-(2-quinolyl) ethylene.

The above-mentioned dye precursors may be employed alone, in a mixture of two or more thereof, or in a mixture of one or more thereof with at least one complementary dye precursor. For example, a black color-forming dye precursor may be a mixture of red, green and blue color-forming dye precursor compounds.

The dye precursors usable for the present invention may be selected from oxidative dye precursors which are different from the above-mentioned dye precursors which are electron-donating compounds. Also, the dye precursors may be selected from diazonium compounds which can form a color upon reacting with a coupler. The above-mentioned oxidative dye precursors and diazonium dye precursors can be contained in the fine solid composite particles.

The polyvalent isocyanate compounds usable for the present invention can be polymerized upon reacting with water into a polyurea resin or a polyurethane polyurea resin. The polymerization component may consist of at least one polyvalent isocyanate compound alone. Also, the polymerization component may consist of a mixture of a polyvalent isocyanate compound with a polyol compound reactive with the isocyanate compound, an adduct of the polyvalent isocyanate compound with the polyol compound, or a prepolymerized isocyanate, for example, biuret compound or isocyanurate compound of the polyvalent isocyanate compound.

These polyvalent isocyanate compounds can dissolve therein the dye precursor. The solution of the dye precursor in the polyvalent isocyanate-containing polymerization component is emulsified in an aqueous medium containing, for example, a protective colloid substance such as polyvinyl alcohol, and the resultant aqueous emulsion is optionally mixed with an additional polymerization component, for example, a polyamine compound. The aqueous emulsion is subjected to a polymerization procedure at an elevated temperature to form a thermoplastic resinous matrix consisting of a polyurea or polyurethane polyurea resin from the polymerization component. The resultant fine solid composite particles contain the dye precursor solid-dissolved in the resultant resinous matrix.

The polyvalent isocyanate compound usable as a polymerization component can be selected from, diisocyanate compounds, for example, m-phenylene diisocyanate, p-phenylene diisocyanate, 2,6-tolylene diisocyanate, 2,4-tolylene diisocyanate, naphthalene-1,4-diisocyanate, diphenylmethane-4,4'-diisocyanate, dicyclohexylmethane-4,4'-diisocyanate, 5-isocyanate-1-(isocyanatomethyl)-1,3,3-trimethylcyclohexane, tetramethylxylylene diisocyanate, 1,3-bis(isocyanatomethyl)cyclohexane, 3,3'-dimethyldiphenylmethane-4,4'-diisocyanate, xylylene-1,4-diisocyanate, 4,4'-diphenylpropane diisocyanate, trimethylene diisocyanate, hexamethylene diisocyanate, propylene-1,2-diisocyanate, butylene-1,2-diisocyanate, and cyclohexylene-1,4-diisocyanate; triisocyanate compounds, for example, 4,4',4"-triphenylmethane triisocyanate and toluene-2,4,6-triisocyanate; and tetraisocyanate compounds, for example, 4,4'-dimethyldiphenylmethane-2,2',5,5'-tetraisocyanate. The polyvalent isocyanate compounds include adducts of polyvalent isocyanate compounds with polyol compounds. The adducts include isocyanate prepolymers, for example, adducts of hexamethylene diisocyanate with trimethylolpropane, adducts of 2,4-tolylene diisocyanate with trimethylolpropane, adducts of xylene diisocyanate with trimethylolpropane, and adducts of tolylene diisocyanate with hexanetriol. Also, the polyvalent isocyanate compounds include prepolymers, for example, biuret compounds and isocyanulate compounds of the polyvalent isocyanates, for example, hexamethylene diisocyanate.

In the present invention, to obtain the fine solid composite particles which can securely isolate the dye precursor from the color-developing agent, it is preferable to employ, as a polymerization component, aliphatic polyvalent isocyanate compounds rather than aromatic polyvalent isocyanate compounds. For this purpose, the polymerization component preferably comprises at least one member selected from hexamethylene diisocyanate, hexamethylene diisocyanate-trimethylolpropane adducts, hexamethylene diisocyanate biuret compounds, hexamethylene diisocyanate isocyanulate compounds, dicyclohexylmethane-4,4'-diisocyanate, and 5-isocyanato-1-(isocyanatomethyl)-1,3,3-trimethylcyclohexane. Among these compounds, the resinous matrix formed from dicyclohexylmethane-4,4'-diisocyanate exhibits an excellent isolating property for the dye precursor and thus is useful for the present invention.

The polyol compounds which can be optionally contained in the polymerization component include aliphatic polyol compounds, for example, ethylene glycol, 1,3-propanediol, 1,4-butanediol, 1,5-pentanediol, 1,6-hexanediol, 1,7-heptanediol, 1,8-octanediol, propylene glycol, 2,3-dihydroxybutane, 1,2-dihydroxybutane, 1,3-dihydroxybutane, 2,2-dimethyl-1,3-propanediol, 2,4-pentanediol, 2,5-hexanediol, 3-methyl-1,5-pentanediol, 1,4-cyclohexanedimethanol, dihydroxycyclohexane, diethyleneglycol, 1,2,6-trihydroxyhexane, phenylethyleneglcyol, 1,1,1-trimethylolpropane, hexanetriol, pentaerythritol and glycerol; condensation reaction product of alkylene oxides with aromatic polyhydric alcohols, for example, 1,4-di(2-hydroxyethoxy)benzene and 1,3-bis(2-hydroxyethoxy)benzene; aromatic polyhydric alcohols, for example, p-xylyleneglycol, m-xylyleneglycol, α,α,-dihydroxy-p-diisopropylbenzene, 4,4'-dihydroxydiphenylmethane, 2-(p,p'-dihydroxydiphenylmethyl)benzylalcohol, 4,4'-isopropylidenediphenol, 4,4'-dihydroxydiphenylsulfone, 4,4'-dihydroxydiphenylsulfide, ethyleneoxide adducts of 4,4'-isopropylidenediphenol, and propyleneoxide adducts of 4,4'-isopropylidenediphenol; and hydroxyl group-containing acrylates, for example, 2-hydroxyacrylates.

The polyvalent isocyanate compounds which are indispensable for the polymerization component and the polyol compounds which are optionally employed usable for the present invention are not limited to those mentioned above and can be employed in a mixture of two or more thereof.

The polyamine compounds optionally usable for the preparation of the dye precursor-containing composite particles includes, for example, ethylenediamine, trimethylenediamine, tetramethylenediamine, pentamethylenediamine, hexamethylenediamine, p-phenylenediamine, m-phenylenediamine, piperazine, 2-methylpiperazine, 2,5-dimethylpiperazine, 2-hydroxytrimethylenediamine, diethylenetriamine, triethylenetriamine, triethylenetetramine, diethylaminopropylamine, tetraethylenepentamine and amine-adducts of epoxy compounds. As far as the purpose of the present invention can be attained, the polymerization component may contain other polymeric substance than those mentioned above.

In the preparation of the dye-precursor-containing fine solid composite particles, the solute optionally comprises, in addition to the dye precursor, at least one fusible organic compound. Therefore, in the resultant fine solid composite particles, the fusible organic compound is contained, together with the dye precursor, in the polyplastic resinous matrix.

The fusible organic compound preferably has a melting temperature of 40° to 150° C. and a boiling temperature of 200° C. or more.

The fusible organic compound is preferably selected from thermosensitizing compounds, which can promote the color formation of the dye precursor, for example, aromatic ketone compounds, for example, benzophenone; aromatic ether compounds, for example, 1,2-di(m-tolyloxy)ethane, 1,2-diphenoxyethane, 1-(4-methoxyphenoxy)-2-(2-methylphenoxy)ethane; and aromatic cyclic ester compounds, for example, coumarin and phthalide. These fusible organic compounds may be employed alone or in a mixture of two or more thereof.

In the fine solid composite particles, the content of the dye precursor is preferably in the range of from 5 to 80% by weight, more preferably 20 to 50% by weight, based on the total weight of the fine solid composite particles, to obtain a satisfactory sensitivity on the color-formation.

In the preparation of the fine solid composite particles, the total weight of the dye precursor, the polyvalent isocyanate compound and optionally the fusible organic compound is preferably 80% or more of the total weight of the solute solution in the solvent.

The aqueous medium for emulsifying the aqueous solution containing the dye precursor dissolved in the polymerization component may contain at least one an emulsifying agent, for example selected from emulsifying surfactants, protective colloid substances. The protective colloid substances include water-soluble polymeric compounds, for example, polyacrylamide, polyvinyl pyrrolidone, polyvinyl alcohol, modified polyvinyl alcohols, for example, sulfone-modified polyvinyl alcohols, methylcellulose, carboxymethylcellulose, styrene-maleic anhydride copolymers and derivatives thereof. The solute solution may contain a small amount of a defoaming agent.

There is no limitation to the amount of the emulsifying agent in the emulsifying medium. Usually, the emulsifying agent is employed in an amount of 1 to 50% by weight, more preferably 3–30%, based on the total weight of the resultant fine solid composite particles.

The fine solid composite particles optionally comprises a ultraviolet ray-absorbing agent, antioxidant, oil-soluble fluorescent brightening agent, releasing agent, and thermosensitizing agent for the dye precursor. These substances are preferably in the state of a solid at room temperature. Nevertheless, these substances may be in the state of a liquid at room temperature, as along as the resultant composite particles contain substantially no liquid.

The sensitizing agent can be selected from p-benzylbiphenyl, dibenzyl terephthalate, phenyl 1-hydroxy-2-naphthoate, dibenzyl oxalate, di-o-chlorobenzyl adipate, 1,2-diphenoxymethane, 1,2-bis(3-methylphenoxy)ethane, di-p-methylbenzyl oxalate, di-p-chlorobenzyl oxalate, 1,2-bis(3,4-dimethylphenyl)ethane, 1,3-bis(2-naphthoxy)propane, meta-terphenyl, diphenyl and benzophenone.

The ultraviolet ray-absorbing agent effectively enhances the light fastness of the colored images formed in the thermosensitive colored image-forming layer. Especially, benzotriazole type ultraviolet ray absorbing agent, for example, 2-(2-hydroxy-5-methylphenyl)-2H-benzotriazole, are preferably used for the present invention, because this type of ultraviolet ray-absorbing agent exhibits not only a light fastness-enhancing effect but also a sensitivity-enhancing effect for the dye precursor.

In the preparation of the fine solid composite particles, the polymerization component may be employed together with a reaction-promoting agent, for example, a tin compound, a polyamide compound, an epoxy compound, and/or a polyamine compound. The polyamine compound is preferably selected from aliphatic polyamine compounds which do not cause the light fastness of the resultant colored images to decrease.

In consideration of the sensitivity for color formation, the fine solid composite particles usable for the present invention preferably have an average size of 0.1 to 15 μm, more preferably 0.3 to 6.0 μm. The smaller the particle size, the higher the sensitivity of the composite particles for color formation. If the average size is too small, the resultant composite particles may cause the resultant thermosensitive colored image-forming layer to exhibit a decreased resistance to fogging.

As mentioned above, the fine solid composite particles can securely isolate the dye precursor from the color developing agent and exhibit a high resistance to collapse, and the resultant colored images derived from the fine solid composite particles exhibit an significantly enhanced resistance to fading due to oily substances, plasticizers, moisture or heat, during storage.

In the thermosensitive recording material, there is no limitation to the type and amount of the color-developing agent, as long as the color-developing agent can be liquefied or dissolved and react with the dye precursor upon heating to develop a color.

The color-developing agent usable for the present invention comprises at least one member selected from phenol compounds, for example, 4-tert-butylphenol, 4-acetylphenol, 4-tert-actylphenol, 4,4'-sec-butylidenediphenyl, 4-phenylphenol, 4,4'-dihydroxydiphenylmethane, 4,4'-isopropylidenediphenyl, 4,4'-cyclohexylidenediphenyl, 1,1-bis(4-hydroxyphenyl)-1-phenylethane, 4,4'-dihydroxydiphenylsulfide, 4,4'-thiobis(3-methyl-6-tert-butylphenol), 4,4'-dihydroxydiphenylsulfone, 2,4'-dihydroxydiphenylsulfone, 4-hydroxy-4'-isopropoxydiphenylsulfone, (3-allyl-4-hydroxyphenyl) sulfone, 4-hydroxybenzophenone, dimethyl 4-hydroxyphthalate, methyl 4-hydroxybenzoate, propyl 4-hydroxybenzoate, sec-butyl 4-hydroxybenzoate, phenyl 4-hydroxybenzoate, benzyl 4-hydroxybenzoate, tolyl 4-hydroxybenzoate, chlorophenyl 4-hydroxybenzoate, and 4,4'-dihydroxydiphenylether; aromatic carboxylic acids, for example, benzoic acid, p-tert-butylbenzoic acid, trichlorobenozic acid, terephthalic acid, salicylic acid, 3-tert-butyl salicylic acid, 3-isopropyl salicylic acid, 3-benzylsalicylic acid, 3-(α-methylbenzyl)salicylic acid, and 3,5-di-tert-butyl salicylic acid; and salts of the above-mentioned phenol compounds and the aromatic carboxylic acids with multivalent metals, for example, zinc, magnesium, aluminum and calcium. Preferably, the color developing agent is selected from diphenyl sulfone compounds having at least one hydroxyl group, for example, 4,4'-dihydroxydiphenylsulfone, 2,4'-dihydroxydiphenylsulfone, 4-hydroxy-4'-isopropoxydiphenylsulfone, and bis(3-allyl-4-hydroxyphenyl)sulfone. These diphenylsulfone color-developing agents are useful for forming colored images having a high color fastness and an enhanced durability for storage. This specific advantage of the diphenylsulfone color-forming agent is assumed to be derived from a strong electron-absorbing property of the sulfone group. To develop colored images having a high resistance to fading due to oily substances or plasticizers, the color-developing agent is preferably selected from 4,4'-bis(p-toluenesulfonylaminocarbonyl) diphenylmethane and N-(p-toluenesulfonyl)-N'-phenylurea.

In the thermosensitive recording material of the present invention, the color-developing agent is preferably employed in an amount of 100 to 700 parts by weight, more preferably 150 to 400 parts by weight, per 100 parts by weight of the dye precursor. The color-developing agent can be employed alone or in a combination of two or more thereof.

In the thermosensitive recording material of the present invention, the thermosensitive colored image-forming layer optionally contains a colored image-stabilizing agent which preferably contains at least one member selected from phenol compounds, for example, 1,1,3-tris(2-methyl-4-hydroxy-5-cyclohexylphenyl)butane, 1,1,3-tris(2-methyl-4-hydroxy-5-tert-butylphenyl)butane, 1,1-bis(2-methyl-4-hydroxy-5-tert-butylphenyl)butane, 4,4'-[1,4-phenylenebis(1-methylethylidene)]bisphenol and 4,4'-[1,3-phenylenebis(1-methylethylidene)]bisphenol; epoxy compounds, for example, 4-benzyloxyphenyl-4'-(2-methyl-2,3-epoxypropyloxy)phenylsulfone, 4-(2-methyl-1,2-epoxyethyl)diphenylsulfone, and 4-(2-ethyl-1,2-epoxyethyl) diphenylsulfone; and isocyanuric acid compounds, for example, 1,3,5-tris(2,6-dimethylbenzyl-3-hydroxy-4-tert-butyl)isocyanuric acid. Of course, the colored image-stabilizing agents are not limited to those mentioned above, and can be employed alone or in a mixture of two or more thereof.

The thermosensitive colored image-forming layer optionally contains a sensitizing agent for the color-forming system. The sensitizing agent comprises at least one member selected from, for example, p-benzylbiphenyl, dibenzyl terephthalate, phenyl 1-hydroxy-2-naphthoate, dibenzyl oxalate, o-chlorobenzyl adipate, 1,2-di(3-methylphenoxy) ethane, di-p-methylbenzyl oxalate, di-p-chlorobenzyl oxalate, 1,2-diphenoxyethane, 1,2-bis(3,4-dimethylphenyl) ethane and 1,3-bis(2-naphthoxy)propane. Especially, when di-p-methylbenzyl oxalate and di-p-chlorobenzyl oxalate are used as a sensitizing agent, the resultant thermosensitive colored image-forming layer exhibits an enhanced resistance to fogging and a high sensitivity.

The color-developing agent, the colored image-stabilizing agent and the sensitizing agent are ground in an aqueous medium, typically water, by a wet grinding machine (mill), for example, sand grinder, atomizer or ball mill, and are dispersed in an aqueous medium containing a water-soluble polymeric protective colloid substance, for example, polyacrylamide, polyvinylpyrrolidone, polyvinyl alcohol, modified polyvinyl alcohol, for example, sulfone group-modified polyvinyl alcohol, methyl cellulose, carboxymethyl cellulose, styrene-maleic anhydride copolymers and derivatives thereof, and optionally a surfactant and defoaming agent. The resultant dispersion is mixed into a dispersion of the fine solid composite particles for preparing the thermosensitive colored image-forming layer. Alternatively, the above-mentioned additives are dissolved in a solvent, the resultant solution is emulsified in an aqueous medium containing the above-mentioned water-soluble polymeric compound, and the resultant aqueous emulsion is mixed into the fine solid composite particle-containing dispersion. Alternatively, those additive are contained in fine solid composite particles separately prepared by the similar method as that for the dye precursor-containing composite particles.

To enhance a whiteness of the thermosensitive colored image-forming layer and a uniformity (evenness) of the colored images, the thermosensitive colored image-forming layer may contain a plurality of fine pigment particles having a high whiteness and an average particle size of 10 μm or less. The pigment is preferably selected from inorganic pigments, for example, calcium carbonate, magnesium carbonate, kaolin, clay, talc, sintered clay, silica, diatomaceous earth, synthetic aluminum silicate, zinc oxide, titanium dioxide, aluminum hydroxide, barium sulfate and surface-treated calcium carbonate and silica; and organic pigments, for example, urea-formaldehyde resin, styrene-methacrylic acid copolymer resin, and polystyrene resins. To prevent a sticking phenomenon of thermal head of printer, a pigment having an oil absorption of 50 ml/100 g or more is preferably employed. The pigment is preferably used in an amount of 50% by weight based on the total weight of the thermosensitive colored image-forming layer. If the amount of the pigment is more than 50% by weight, the resultant colored images may be unsatisfactory in the color density thereof.

The thermosensitive colored image-forming layer comprises a binder in addition to the dye precursor-containing fine solid composite particles, the color developing agent and optionally another additive, for example, a cross-linking agent, wax, metal soap, coloring dye, coloring pigment, and fluorescent brightening agent.

The binder preferably comprises at least one member selected from water-soluble polymeric materials, for example, polyvinyl alcohol, functional group-modified polyvinyl alcohols, starch, modified starches, cellulose compounds, for example, hydroxymethyl cellulose, hydroxyethyl cellulose, hydroxypropyl cellulose, methyl cellulose, and ethyl cellulose, polyacrylic acid sodium salt, polyvinyl pyrrolidone, acrylamide-acrylic acid ester copolymers, acrylamide-acrylic acid ester-methacrylic acid ester copolymers, styrene-maleic anhydride copolymers, isobutylene-maleic anhydride copolymers, casein and gelatin and derivatives thereof; and emulsions of, for example, polyvinyl acetate, polyurethane, polyacrylic acid polyacrylic acid esters, vinylchloride-vinyl acetate copolymers, polybutyl methacrylate, ethylene-vinyl acetate copolymers; and lattices of water-insoluble polymers, for example, styrene-butadiene copolymers, and styrene-butadinene-acrylic compound copolymers.

The cross-linking agent is contributory to curing three-dimensionally the binder and to enhancing a water resistance of the thermosensitive colored image-forming layer. The cross-linking agent preferably comprises at least one member selected from, for example, aldehyde compounds, for example, glyoxal, polyamine compounds, for example, polyethyleneimine, epoxy compounds, polyamide resins, melamine resins, dimethylolurea compounds, aziridine compounds, blocking isocyanate compounds, inorganic compounds, for example, ammonium persulfate, ferric chloride, magnesium dichloride, sodium tetraborate, and potassium tetraborate; and boric acid compounds, for example, boric acid, boric acid triester and boron-containing polymers. The cross-linking agent is preferably employed in an amount of 1 to 10% by weight based on the total weight of the thermosensitive colored image-forming layer.

The waxes which are optionally contained in the thermosensitive colored image-forming layer include paraffin waxes, carnauba waxes, microcrystalline waxes, polyolefin waxes, polyethylene waxes, higher fatty acid amides, for example, stearic acid amide and ethylenebisstearic acid amide, higher fatty acid esters and derivatives thereof.

Especially, when methylol-modified fatty acid amide is added, the resultant thermosensitive colored image-forming layer exhibits an enhanced sensitizing effect without reducing the resistance to fogging.

The metal soaps may be selected from polyvalent metal salts of higher fatty acids, for example, zinc stearate, aluminum stearate, calcium stearate and zinc oleate.

The coloring dye or pigment is used as a complementary coloring matter for the color of the images. The complementary coloring matter is contributory to brightening the thermosensitive colored image-forming layer.

The thermosensitive colored image-forming layer optionally further contains an oil-repellent agent, deforming agent, and viscosity-regulating agent, unless the effect of the present invention is degraded.

In the thermosensitive recording material of the present invention, the support is not limited to specific type of material having specific form and dimensions. The support can be formed from, for example, non-coated paper sheets (acid or neutral paper sheets), rough paper sheets, coated paper sheets, art paper sheets, cart-coated paper sheets, glassing paper sheets, resin-laminated paper sheets, synthetic polyolefin paper sheets, synthetic fiber sheets, non-woven fabrics and synthetic resin films, and other clear support materials.

An embodiment of the thermosensitive recording material is a thermosensitive multi-colored image recording material.

In a first embodiment of the thermosensitive multi-colored image recording material, the thermosensitive colored image-forming layer contains, in addition to the color-developing agent and the binder, a plurality of fine solid composite particles having a first dye precursor solid dissolved in the thermoplastic resinous matrix thereof, and a plurality of fine solid particles of a second dye precursor different in developed color from the first dye precursor, and thus the colored images can be formed in two different colors in the thermosensitive colored image-forming layer.

The fine solid particles of the second dye precursor preferably can react with the color-developing agent at a lower temperature than that of the first dye precursor contained in the fine solid composite particles to form a color different from the first dye precursor.

In this embodiment, preferably the first dye precursor in the fine solid composite particles is capable of forming a black color and the second dye precursor is capable of forming a different color from the black color.

In the first embodiment, the second dye precursor particles can be color-developed by the color-developing agent at a lower temperature than that of the first dye precursor contained in the fine solid composite particles. Therefore, when the multi-colored image forming layer is heated imagewise at a lower temperature, only the second dye precursor is color-developed to form a color, and when the multi-colored image-forming layer is heated imagewise to a higher temperature, the first dye precursor in the composite particles and the second dye precursor are concurrently developed to form a mixed color.

In a second embodiment of the thermosensitive recording material of the present invention, the colored image forming layer contains, in addition to the color-developing agent and the binder, a plurality of first fine solid composite particles having a first dye precursor solid dissolved in a first thermoplastic resinous matrix thereof, and a plurality of second fine solid composite particles having a second dye precursor solid-dissolved in a second thermoplastic resinous matrix thereof and different in developed color from the first dye precursor, the first and second fine solid composite particles being different in color-forming temperature from each other, and thus colored images can be formed in two different colors in the thermosensitive colored image-forming layer. In other words, the second embodiment of the thermosensitive multi-colored image-forming layer contains first and second dye precursor-containing solid composite particles different from each other in developed color and in color-forming temperature, and thus is capable of recording colored images in two different colors. For example, the first dye-precursor-containing solid composite particle (first composite particles) have a particle size larger than that of the second dye precursor-containing composite particles (second composite particles) and thus exhibits a lower thermal color-forming sensitivity than that of the second composite particles. The particle size of the first composite particles is preferably 3.0 to 10.0 $\mu$m and the particle size of the second composite particles is preferably 0.1 to 1.0 $\mu$m.

Alternatively, the first fine solid composite particles have a color-forming temperature higher than that of the second fine solid composite particles. The color-forming temperatures of the first and second fine solid composite particles can be adjusted by differentiating the types of the first and second resinous matrixes from each other.

When the thermosensitive multi-colored image-forming layer is heated imagewise at a lower temperature, only the second composite particle can form colored images, and when the multi-colored image-forming layer is further heated imagewise at a higher temperature, the second composite particles and the first composite particles can form colored images with a mixed color.

In a third embodiment of the thermosensitive recording material of the present invention which is a modification of the second embodiment, the thermosensitive colored image layer comprises, in addition to the color-developing agent, the binder, the first fine solid composite particles having the first dye precursor and the second fine solid composite particles having the second dye precursor, a plurality of fine solid particles of a third dye precursor different in developed color from the first and second dye precursors, and thus is capable of recording therein colored images in three different colors.

Where the third dye precursor can be developed to form a color at a temperature lower than the second dye precursor contained in the second composite particles, and the second dye precursor can be developed to form another color at a temperature lower than the first dye precursor contained in the first composite particles, colored images derived from the third dye precursor can be formed at a lower temperature, a mixed colored images derived from the third and second dye precursors at a higher temperature, and a further mixed colored images derived from the third, second and first dye precursors can be formed at a further elevated temperature. Namely, the thermosensitive colored image-forming layer of the third embodiment can record therein colored images in three different colors.

In a fourth embodiment of the present invention, the thermosensitive multi-colored image-recording material has a first thermosensitive colored image-forming layer comprising a plurality of first fine solid composite particles having a first dye precursor solid-dissolved in a first thermoplastic resinous matrix, in addition to the color-developing agent and the binder, and formed on the support; and a second thermosensitive colored image-forming layer formed on the first layer or between the support and the first layer, and comprising a plurality of fine solid particles of a second dye precursor different in developed color from the first dye precursor, in addition to the color-developing agent and the binder. Therefore, the recording material of the fourth embodiment is capable of recording therein colored images in two different colors.

In the fourth embodiment, the second dye precursor is not solid-dissolved in the thermoplastic resinous matrix of the fine solid composite particles and thus can be color-developed at a lower temperature than the color-forming temperature of the first dye precursor-containing fine solid composite particles in the first colored image-forming layer. When the recording material is heated imagewise at a lower temperature, only the colored images derived from the second dye precursor are formed, and then when the recording material is heated imagewise at a higher temperature, other colored images are formed from the first and second dye precursors in a mixed color.

When the second or third dye precursor is used in the form of fine solid particles, preferably the second or third dye precursor is ground by using a wet grinder or mill, for example, a sand grinder, atomizer or ball mill, and dispersed in an aqueous medium comprising a water-soluble polymeric compound, for example, polyacrylamide, polyvinyl pyrrolidone, polyvinyl alcohol, modified polyvinyl alcohol such as sulfone group-modified polyvinyl alcohol, methyl cellulose, carboxymethyl cellulose, styrene-maleic anhydride copolymer or a derivative thereof and, optionally, a surfactant or a defoaming agent. The aqueous dispersion of the second or third dye precursor is added to a coating liquid for the second dye precursor-containing colored image-forming layer.

Alternatively, the second or third dye precursor is dissolved in a solvent, the resultant solution is emulsified in an aqueous medium containing the water-soluble polymeric material, and the resultant emulsion is subjected to a solvent evaporation procedure in which the solvent is evaporated away and thus the aqueous emulsion is converted to an aqueous dispersion of fine solid particles of the second or third dye precursor.

The fine solid particles of the second or third dye precursor preferably has a particle size of 0.1 to 3.0 $\mu$m, more preferably 0.3 to 1.0 $\mu$m.

A fifth embodiment of the thermosensitive recording material of the present invention is a modification of the fourth embodiment and has a first colored image-forming layer containing a first dye precursor solid-dissolved in a thermoplastic resinous matrix of fine solid composite particles and a plurality of fine solid particles of a second dye precursor capable of forming a color different in color from the first dye precursor, in addition to the color-developing agent and the binder, and a second colored-image-forming layer containing a plurality of fine solid particles of a third dye precursor capable of forming a color different from that of the first and second dye precursors, in addition to the color-developing agent and the binder.

The fifth embodiment of the thermosensitive recording material can record therein, for example, colored images derived from the third dye precursor, mixed colored images derived from the third and second dye precursors and further mixed colored images derived from the first, second and third dye precursors.

In a sixth embodiment of the present invention, the thermosensitive recording material has a first thermosensitive colored image-forming layer formed on the support and comprising a plurality of first fine solid composite particles having a first dye precursor solid-dissolved in a first thermoplastic resinous matrix thereof, and a plurality of fine solid particles of a second dye precursor different in developed color from the first dye precursor, in addition to the color-developing agent and the binder, and a second thermosensitive colored image-forming layer located on the first layer or between the first layer and the support and comprising a plurality of second fine solid composite particles, having a third dye precursor solid-dissolved in a second thermoplastic resinous matrix thereof, and different in developed color from the first and second dye precursor, the first and second fine solid composite particles being different in color-forming temperature from each other, and thereby the recording material being capable of recording colored images in three different colors.

In the sixth embodiment, the recording material can record therein, for example, colored images derived from the second dye precursor in the first layer at a lower temperature, mixed colored images derived from the second and first dye precursors in the first layer at a higher temperature and further mixed colored images derived from the first, second and third dye precursors at a further elevated temperature.

In each of the above-mentioned embodiments, each colored image-forming layer optionally contains a colored image-stabilizing agent, a sensitizing agent and/or a pigment.

The fourth, fifth and sixth embodiments of the present invention can be modified by adding one or more additional colored image forming layers comprising a fourth dye precursor different in developed color from the first, second and third dye precursors, in the form of fine solid particles or fine solid composite particles and located in the outermost surface of the recording material or between two of the support and the first and second layers. In this embodiment, the recording material can record therein colored images in four or more different colors.

In the multi colored image-recording material of the present invention, a plurality of dye precursors must have different thermal color-forming sensitivity from each other and must be able to form different colors at different temperatures from each other.

To the thermosensitive recording material of the present invention, additional functions can be imparted by applying additional works. For example, the recording material can be processed by applying a pressure-sensitive adhesive, remoisturing adhesive or delayed tackifier to a back surface of the recording material, to provide an adhesive paper sheet, remoisturing adhesive paper sheet or delayed tack paper sheet. Alternatively, a magnetic layer is formed on the back surface of the recording material to provide a thermosensitive and magnetic recording material.

Especially, the recording material having a tacky layer or a magnetic recording layer are usable as a thermosensitive two differently colored image-recording label, or thermosensitive two differently colored image and magnetic image-recording passenger ticket. Also, the back surface of the recording sheet can be utilized to provide a thermal transfer recording sheet, ink jet-recording sheet, pressure-sensitive recording sheet, electrostatic recording sheet or xerographic recording sheet. Namely, both the front and back surfaces of the recording material can be used for recording. Also, two thermosensitive colored image-forming layers can be formed on both the front and back surfaces of the recording material.

In the thermosensitive recording material of the present invention, a protective overcoat layer may be formed on the thermosensitive colored image-forming layer and/or an undercoat layer may be formed between the support and the thermosensitive colored image-forming layer. The protective overcoat layer and the undercoat layer may be formed from conventional materials for conventional overcoat and undercoat layers, for example, a mixture of a pigment with a binder. Particularly, the protective overcoat layer preferably contains a lubricant, for example, a polyolefin wax or zinc stearate, to prevent the sticking phenomenon of a thermal head. The protective uppercoat layer may be formed in a multi-layered structure. The protective uppercoat layer may have a high gloss, to enhance the commercial value thereof. For the undercoat layer, a pigment having a high porosity, for example, silica or calcined kaolin can be used to enhance the color-forming sensitivity of the thermosensitive colored image-forming layer. When a plastic resin pigment, hollow particles or foamed pigments are contained, the resultant overcoat coat can enhance the color-forming sensitivity of the thermosensitive colored image-forming layer formed on the undercoat layer.

Further, on the thermosensitive colored image-forming layer, a protective overcoat layer comprising an electron beam-cured resin or ultraviolet ray-cured resin can be formed. Printing with a UV ink or flexographic ink can be applied to a front or back surface of the protective uppercoat layer. Also, by adding a releasing agent, for example, a silicone releasing agent to the protective uppercoat layer, the thermosensitive recording material of the present invention can be utilized as a linerless pressure-sensitive label. For this utilization, the releasing agent may be applied after printing.

In the production of the thermosensitive recording material of the present invention, the coating layer can be formed by a conventional coating method, for example, an air knife method, blade method, gravure method, roll coater method, spray method, dipping method or extrusion method. Otherwise, the coating liquid for the thermosensitive colored image-forming layer can be locally applied by using a printer.

The coating liquid for the thermosensitive colored image-forming layer is coated on a surface of a support usually in an amount corresponding to a dry weight of 1 to 20 g/m$^2$, and dried to form the thermosensitive colored image-forming layer.

The thermosensitive recording material of the present invention may have a backcoat layer to prevent a penetration of an oily substance or plasticizer into the recording material through the back surface of the recording material, or to enhance a resistance of the recording material to curling.

The thermosensitive colored image-forming layer is optionally smoothed by using a smoothing means, for example, a super calender or a soft calender, to enhance the color-forming sensitivity thereof. In this smoothing procedure, the thermosensitive colored image-forming layer is brought into contact with a metal roll or an elastic roll.

EXAMPLES

The present invention will be further explained by the following examples which are merely representative and do not intend to restrict the scope of the present invention in any way.

Example 1

Preparation of dye-precursor-containing fine solid composite particles

A black color-forming dye precursor consisting of 3-di(n-amyl)amino-6-methyl-7-anilinofluoran in an amount of 6 parts by weight was dissolved in 24 parts by weight of dicyclohexylmethane-4,4'-diisocyanate at a temperature of 100° C. The resultant solution was gradually added to 250 parts by weight of an aqueous solution of 8% by weight of polyvinyl alcohol (available under the trademark of Gosenol GM-14L, from Nihon Goseikagakukogyo K.K.), and the mixture was emulsified by using a homogenizer at 5,000 rpm. The resultant aqueous emulsion was stabilized by adding 100 parts by weight of water thereto. The stabilized aqueous emulsion was heated upto a temperature of 90° C. and maintained at this temperature for 10 hours to polymerize the polyvalent isocyanate compound. A plurality of fine solid composite particles (A) containing the black color-forming dye precursor dissolved in the solid thermoplastic resinous matrix derived from the polyvalent isocyanate compound and having an average particle size of 1.3 μm were obtained in the form of an aqueous dispersion.

Electron microscopic observation of the fine solid composite particles (A)

A dispersion of the fine solid composite particles (A) were coated on an aluminum foil, dried, and frozen by using a liquid nitrogen, and the frozen composite particles were broken. The broken profiles of the composite particles (A) were observed by an electron microscope (Scanning Electron Microscope S-800, made by Hitachi Seisakusho, under an acceleration voltage of 20 kV at a magnification of 500 to 10,000.

The resultant electron microscopic view of the frozen, broken composite particles (A) is shown in FIG. 1.

FIG. 1 shows that the composite particles (A) are provided with a plurality of small pores. The size of the small pores is less than ⅓ of the average size of the composite particles (A).

Preparation of a thermosensitive recording material (1) Preparation of aqueous emulsions of a color-developing agent and sensitizing agent A color developing agent consisting of 4,4'-isopropylidenediphenyl and a sensitizing agent consisting of di-p-methylbenzyl oxalate were separately mixed with an aqueous polyvinyl alcohol solution in the following composition, and each mixture was subjected to a grind-dispersing procedure using a vertical type sand mill (Sand Grinder made by Aymex K.K.) to provide fine particles having an average particle size of 1.2 μm.

| Component | Part by weight |
|---|---|
| Color-developing agent or sensitizing agent | 40 |
| 10% aqueous polyvinyl alcohol solution (*)$_1$ | 40 |
| Water | 20 |

Note:
The polyvinyl alcohol had a degree of polymerization of 500 and a degree of saponification of 90%.

Preparation of a pigment dispersion

An aqueous pigment dispersion was prepared by mixing silica having an oil absorption of 190 ml/100 g (available under the trademark of Mizukasil P527, made by Mizusawa Kagakukogyo K.K.) with an aqueous polyacrylic acid sodium salt in the following composition, and the mixture was subjected to a dispersion procedure using a Cowless disperser.

| Component | Part by weight |
|---|---|
| Silica | 30 |
| 0.7% aqueous polyacrylic acid sodium salt solution | 70 |

Separately, a binder solution consisting of an aqueous solution of 10% by solid weight of polyvinyl alcohol (available under the trademark of Gosenol NM11Q, from Nihon Goseikagakukogyo K.K.) and a lubricant dispersion consisting of an aqueous dispersion of 21% by solid weight of zinc stearate (available under a trademark of Z-7 from Chukyo Yushi K.K.) were provided.

Undercoating

The aqueous pigment dispersion and the binder solution was mixed in a solid weight mixing ratio of 85:15 to provide a undercoating liquid. This undercoating liquid was coated in an amount corresponding to a dry solid weight of 5.0 g/m$^2$ on a surface of a neutral wood-free paper sheet with a basis weight of 60 g/m$^2$ by using a Mayer bar, and dried to form an undercoat layer.

Production of a thermosensitive recording material

A coating liquid was prepared by mixing the fine solid composite particle (A) dispersion, the color-developing agent dispersion, the sensitizing agent dispersion, the pigment dispersion, the binder solution and the lubricant dispersion altogether in a solid weight mixing ratio of 30:25:15:15:3:5. The resultant coating liquid was coated in an amount corresponding to a dry solid weight of 5.0 g/m$^2$ on the undercoat layer on the support by using a Mayer bar, and dried to form a thermosensitive colored image-forming layer.

A thermosensitive recording material was obtained.

Tests for the thermosensitive recording material

The thermosensitive colored image-forming layer surface of the recording material was smoothed into a Bekk smoothness of 10 to 150 seconds in accordance with Japanese Industrial Standard (JIS) P8119 by using a super calender.

Before and after the calender treatment, the whiteness of the recording material was measured in accordance with JIS P8123. When the whiteness after the calender treatment is 75 or more, the recording material is evaluated as having a satisfactory whiteness and exhibiting a bright appearance.

The smoothed thermosensitive recording material was subjected to a thermosensitive recording test using a thermosensitive printing tester (trademark: TH-PMD, made by Okura Denki K.K.) at a one line recording time of 5 m sec, at a sub-scanning line density of 8 lines/mm, and with a printing energy of 1.0 mJ per dot. During the printing test, a solid print image consisting of 256 lines was formed.

The color density of the solid print image was measured by using McBeth Color Tester (trademark: RD-914, made by McBeth), before the storage test which will be explained below.

When the color density of the solid print image is 1.1 or more, the recording material is evaluated as having a practically satisfactory color-forming property, and when the color density is 1.3 or more, the recording material is evaluated as being excellent in the color-forming property.

To test the storage stability, the recording material was left to stand at a temperature of 50° C., at a relative humidity of 90% RH for 120 hours, and thereafter was subjected to a Hunter whiteness test in accordance with JIS P8123. A whiteness of 62 or more is satisfactory for practical use, a whiteness of 65 or more is excellent, and whiteness of 70 or more is extremely excellent.

To test the resistance of the colored images to fading, an imagewisely printed recording material was left to stand at a temperature of 50° C., at a relative humidity of 90% RH for 120 hours, and then subjected to a color density test and a whiteness test. When the color density of the storage-treated colored images is 0.80 or more, the fade resistance of the colored image is satisfactory for practice, 0.90 or more is excellent and 1.0 or more is extremely excellent. The whiteness of the non-printed portions of the storage treated recording material of 62 or more is satisfactory for practice, 65 or more is excellent and 70 or more is extremely excellent.

The test results are shown in Table 1.

Example 2

A thermosensitive recording material was produced and tested by the same procedures as in Example 1 with the following exceptions.

In the preparation of the dye precursor-containing fine solid composite particles, 24 parts by weight of dicyclohexylmethane-4,4'-diisocyanate were replaced by 20 parts by weight of dicyclohexylmethane-4,4'-diisocyanate, and 4 parts by weight of a fusible organic substance consisting of benzophenone were added to the dye precursor solution. The resultant black color-forming dye precursor-containing fine solid composite particles (B) had an average particle size of 1.6 $\mu$m, and were in the form of an aqueous dispersion.

The test results are shown in Table 1.

Example 3

A thermosensitive recording material was produced and tested by the same procedures as in Example 1 with the following exceptions.

In the preparation of the dye precursor-containing fine solid composite particles, 24 parts by weight of dicyclohexylmethane-4,4' diisocyanate were replaced by 24 parts by weight of an adduct of trimethylolpropane with xylylenediisocyanate in a molar ratio of 1:3. The resultant black color-forming dye precursor-containing fine solid composite particles (C) had an average particle size of 1.5 $\mu$m, and were in the form of an aqueous dispersion.

The test results are shown in Table 1.

Example 4

A thermosensitive recording material was produced and tested by the same procedures as in Example 1 with the following exceptions.

In the preparation of the dye precursor-containing fine solid composite particles, 24 parts by weight of dicyclohexylmethane-4,4'-diisocyanate were replaced by 24 parts by weight of 5-isocyanato-1-(isocyanatomethyl)-1,3,3-trimethylcyclohexane. The resultant black color-forming dye precursor-containing fine solid composite particles (D) had an average particle size of 1.4 $\mu$m, and were in the form of an aqueous dispersion.

The test results are shown in Table 1.

Example 5

A thermosensitive recording material was produced and tested by the same procedures as in Example 1 with the following exceptions.

In the formation of the thermosensitive colored image-forming layer, 6 parts by weight of 3-di(n-amyl)amino-6-methyl-7-anilinofluoran were replaced by 5 parts by weight of 3-di(n-amyl)amino-6-methyl-7-anilinofluoran and 1 part by weight of an ultraviolet ray-absorbing agent consisting of 2-(2-hydroxy-5-methylphenyl)-2H-benzotriazole were added to the dye precursor solution. The resultant black color-forming dye precursor-containing fine solid composite particles (E) had an average particle size of 1.5 $\mu$m, and were in the form of an aqueous dispersion.

The test results are shown in Table 1.

Example 6

A thermosensitive recording material was produced and tested by the same procedures as in Example 1 with the following exceptions.

In the formation of the thermosensitive colored image-forming layer, 3-di(n-amyl)amino-6-methyl-7-anilinofluoran was replaced by 3-di(n-butyl)amino-6-methyl-7-anilinofluoran. The resultant black color-forming dye precursor-containing fine solid composite particles (F) had an average particle size of 1.7 μm, and were in the form of an aqueous dispersion.

The test results are shown in Table 1.

Comparative Example 1

A thermosensitive recording material was produced and tested by the same procedures as in Example 1 with the following exceptions.

In the preparation of the dye precursor-containing fine solid composite particles, a black color-forming dye precursor consisting of 3-di(n-amyl)amino-6-methyl-7-anilinofluoran in an amount of 6 parts by weight was dissolved in 24 parts by weight of methylene chloride, and the resultant solution was mixed with 24 parts by weight of dicyclohexylmethane-4-4'-diisocyanate, to provide a homogeneous solution. The resultant solution, was gradually added to 250 parts by weight of an aqueous solution of 8% by weight of polyvinyl alcohol (available under the trademark of Gosenol GM-14L, from Nihon Goseikagakukogyo K.K.), and the mixture was emulsified by using a homogenizer at 5,000 rpm. The resultant aqueous emulsion was homogenized by adding 100 parts by weight of water thereto. The aqueous emulsion was heated upto a temperature of 90° C. and maintained at this temperature for 10 hours to polymerize the polyvalent isocyanate compound. A plurality of microcapsules (G) having a black color-forming dye precursor-containing core and a shell derived from the polyvalent isocyanate compound and having an average particle size of 7 μm were obtained in the form of an aqueous dispersion.

In the formation of the thermosensitive colored image-forming layer, the composite particles (A) were replaced by the microcapsules (G).

The test results are shown in Table 1.

TABLE 1

| | Whiteness of recording material | | Printed recording material: Color density of colored images | | Printed recording material: Whiteness |
|---|---|---|---|---|---|
| Example No. | Before calendering | After calendering | Before storage test | After storage test | after storage test |
| Example 1 | 77.6 | 75.1 | 1.15 | 1.02 | 72.4 |
| 2 | 77.9 | 75.3 | 1.32 | 1.03 | 70.1 |
| 3 | 77.9 | 75.2 | 1.16 | 0.85 | 62.3 |
| 4 | 78.5 | 75.4 | 1.17 | 0.95 | 67.8 |
| 5 | 77.8 | 75.1 | 1.16 | 0.84 | 65.9 |
| 6 | 78.3 | 75.9 | 1.14 | 1.04 | 72.2 |
| Comparative Example 1 | 77.8 | 72.3 | 1.13 | 0.65 | 60.1 |

Examples 7–26 and Comparative Examples 2 to 7

In each of Examples 7 to 26 and Comparative Examples 2 to 7, a thermosensitive two differently colored image-recording material was produced by the following procedures.

Dye precursor-containing fine solid composite particles (H) to (M) were prepared by the following procedures.

Composite particles (H)

A black color-forming dye precursor consisting of 3-di(n-amyl)amino-6-methyl-7-anilinofluoran in an amount of 6 parts by weight was dissolved in 24 parts by weight of dicyclohexylmethane-4,4'-diisocyanate at a temperature of 100° C. The resultant solution was gradually added to 250 parts by weight of an aqueous solution of 8% by weight of polyvinyl alcohol (available under the trademark of Gosenol GM-14L, from Nihon Goseikagakukogyo K.K.), and the mixture was emulsified by using a homogenizer at 5000 rpm. The resultant aqueous emulsion was homogenized by adding 100 parts by weight of water thereto. The aqueous emulsion was heated upto a temperature of 90° C. and maintained at this temperature for 10 hours to polymerize the polyvalent isocyanate compound. A plurality of fine solid composite particles (H) containing the black color-forming dye precursor dissolved in the solid thermoplastic resinous matrix derived from the polyvalent isocyanate compound and having an average particle size of 2.0 μm were obtained in the form of an aqueous dispersion.

Composite particles (I)

An aqueous dispersion of composite particles (I) was prepared by the same procedures as of the composite particles (H), except that the dicyclohexylmethane-4,4'-diisocyanate was used in an amount of 20 parts by weight, and after the emulsification step, 4 parts by weight of an adduct of ethylenediamine with butyleneoxide were added to the emulsion. In the resultant aqueous dispersion, the resultant black color-forming dye precursor-containing fine solid composite particles (I) had an average particle size of 2.2 μm.

Composite particles (J)

An aqueous dispersion of composite particles (J) was prepared by the same procedures as of the composite particles (H), except that the dicyclohexylmethane-4,4'-diisocyanate was used in an amount of 14 parts by weight, and added with 10 parts by weight of an adduct of trimethylol propane and xylylene diisocyanate in a molar ratio of 1:3, and the polymerization procedure was carried out at 80° C. in place of 90° C. In the resultant aqueous dispersion, the resultant black color-forming dye precursor-containing fine solid composite particles (J) had an average particle size of 2.1 μm.

Composite particles (K)

An aqueous dispersion of composite particles (K) was prepared by the same procedures as of the composite particles (J), except that the 3-di-n-amylamino-6-methyl-7-anilinofluoran was used in an amount of 4 parts by weight, together with 2 parts by weight of a ultraviolet ray-absorbing agent consisting of 2-(2-hydroxy-5-methylphenyl)-2H-benzotriazol (trademark: Tinubin P, made by Ciba-Geigy). In the resultant aqueous dispersion, the resultant fine solid composite particles (K) containing the black color-forming dye precursor and the ultraviolet ray-absorbing agent had an average particle size of 2.2 μm.

Composite particles (L)

An aqueous dispersion of composite particles (L) was prepared by the same procedures as of the composite particles (H), except that the dicyclohexylmethane-4,4'-diisocyanate was used in an amount of 40 parts by weight. In the resultant aqueous dispersion, the resultant black color-forming dye precursor-containing fine solid composite particles (L) had an average particle size of 2.2 μm.

Microcapsules (M) (Comparative)

A black color-forming dye precursor consisting of 3-di-n-amylamino-6-methyl-7-anilinofluoran in an amount of 6 parts by weight was dissolved in 30 parts by weight of methylene chloride. To the resultant solution, 24 parts by weight of dicyclohexylmethane-4,4'-diisocyanate were added and the resultant mixture was homogenized into a solution. The resultant solution was gradually added to 250 parts by weight of an aqueous solution of 8% by weight of polyvinyl alcohol (Gosenol GM-14L) and the resultant mixture was emulsified by using a homogenizer at 5000 rpm. The resultant aqueous emulsion was homogenized by adding 100 parts by weight of water thereto. The aqueous emulsion was heated upto a temperature of 90° C. and maintained at this temperature for 10 hours to polymerize the polyvalent isocyanate compound. A plurality of microcapsules (M) having a black color-forming dye precursor-containing core and a shell derived from the polyvalent isocyanate compound and having an average particle size of 15 μm were obtained in the form of an aqueous dispersion. The composite particles (H) to (L) and the microcapsules (M) are in a substantially spherical form in an electron microscopic view.

In the production of thermosensitive two differently colored image-recording materials, the following chemicals were employed.

<1> Second black color-forming dye precursor
- (a) 3-di-n-amylamino-6-methyl-7-anilinofluoran <2> Second red color-forming dye precursor
- (a) 2-diethylamino-7-chlorofluoran
- (b) 3-diethylamino-6-methyl-7-chlorofluoran
- (c) 3-(N-ethyl-N-tolylamino)-7-methylfuoran <3> Second orange color-forming dye precursor
- (a) 3-cyclohexylamino-6-chlorofluoran
- (b) 3-diethylamino-6,8-dimethylfuoran
- (c) 7-(N-ethyl-N-isoamylamino)-3-methyl-1-phenylspiro[(1,4-dihydrochromeno(2,3-c)pyrazole)-4,3'-phthalide]
- (d) 3-diethylamino-7-tert-butylfluoran <4> Second reddish violet color-forming dye precursor
- (a) 3,3-bis(1-n-butyl-2-methylindole-3-yl)phthalide
- (b) 3-(N-ethyl-N-isoamylamino)-7,8-benzofluoran <5> Second blue color-forming dye precursor
- (a) 3-(4-diethylamino-2-methylphenyl)-3-(4-dimethylaminophenyl)-6-dimethylaminophthalide
- (b) 3,3-bis(p-dimethylaminophenyl)-6-dimethylaminophthalide <6> Second green color-forming dye precursor
- (a) 3,6-bis(dimethylamino)fluorene-9-spiro-3'-(6'-dimethylamino)phthalide
- (b) 3-diethylamino-7-dibenzylaminofluoran <7> Color-developing agent
- (a) Bis(3-allyl-4-hydroxyphenyl)sulfone
- (b) 2,4'-dihydroxydiphenylsulfone
- (c) 4-hydroxy-4'-isopropoxydiphenylsulfone
- (d) 4,4'-isopropylidenediphenol <8> Sensitizing agent
- (a) di-p-methylbenzyl oxalate
- (b) di-p-chlorobenzyl oxalate Preparation of aqueous dispersions of the second dye precursors, the color-developing agents and the sensitizing agents Each of the second dye precursors, the color-developing agents and sensitizing agents were dispersed in an aqueous medium in the following composition to provide an aqueous dispersion.

| Component | Part by weight |
|---|---|
| A second dye precursor, color-developing agent or sensitizing agent | 40 |
| 10% aqueous polyvinyl alcohol solution $(*)_2$ | 20 |

Note:

Degree of polymerization: 500

Degree of saponification: 90%

The mixture was ground and dispersed by a vertical type sand mill (Sand grinder, made by Aymex K.K.) into an average particle size of 1.2 μm.

Preparation of a pigment dispersion

An aqueous pigment dispersion was prepared by mixing silica (Mizukasil P527) having an oil absorption of 190 ml/100 g with a 0.7% aqueous polyacrylic acid sodium salt solution in the following composition, and the mixture was subjected to a dispersion procedure using a Cowless disperser.

| Component | Part by weight |
|---|---|
| Silica | 30 |
| 7% aqueous polyacrylic acid Na-salt | 70 |

Separately, a binder solution consisting of an aqueous solution of 10% by solid weight of polyvinyl alcohol (Gosenol NM11Q) and a lubricant dispersion consisting of an aqueous dispersion of 21% by solid weight of zinc stearate (Z-7) were prepared.

Undercoating

In each of Examples 7 to 26 and Comparative Examples 2 to 7, the aqueous pigment dispersion and the binder solution was mixed in a solid weight mixing ratio of 85:15 to provide a undercoating liquid. This undercoating liquid was coated in an amount corresponding to a dry solid weight of 5.0 g/m$^2$ on a surface of a neutral wood-free paper sheet with a basis weight of 60 g/m$^2$ by using a Mayer bar, and dried to form an undercoat layer.

Production of a thermosensitive two differently colored image-recording material A coating liquid for a thermosensitive two differently colored image forming layer was prepared by mixing the fine solid composite particle dispersion, and the second dye precursor dispersion as shown in Tables 2 and 3, the color-developing agent dispersion, the sensitizing agent dispersion, the pigment dispersion, the binder solution and the lubricant dispersion were mixed altogether in the solid weight mixing ratio shown in Tables 2 and 3. The resultant coating liquid was coated in an amount corresponding to a dry solid weight of 5.0 g/m$^2$ on the undercoat layer on the support by using a mayer bar, and dried to form a thermosensitive two differently colored image-forming layer. The resultant a thermosensitive two differently colored image recording material was surface-treated by a super calender to smooth the surface of the colored image-forming layer to a Bekk smoothness of 100 to 150 seconds determined in accordance with JIS P8119.

Tests for the thermosensitive recording material

To each of the resultant recording materials, the following lower temperature printing operation and higher temperature printing operation were applied by using a thermosensitive printing tester (TH-PMD).

Lower temperature printing operation

Printing time per line: 5 m sec.

Sub-scattering line density: 8 lines/mm

Printing energy per dot: 0.4 mJ

Image: Solid image consisting of 256 lines

Higher temperature printing operation

Printing time per line: 5 m sec.

Sub-scattering line density: 8 lines/mm

Printing energy per dot: 1.5 mJ

Image: Solid image consisting of 256 lines

The quality of the resultant colored images was evaluated by naked eye observation as follows 2: clear and brilliant colored images were obtained 1: Muddy colored images or light colored images were obtained To test the resistance to fogging, the recording material was left to stand at a temperature of 40° C. at a relative humidity of 90% RH for 100 hours, and then the Hunter whiteness of the recording material was measured.

Whiteness of 70 or more:

Satisfactory for practice

Whiteness of 75 or more:

Excellent.

The appearance is good.

The test results are shown in Tables 2 and 3.

TABLE 2

| Item | | Example No. | | | | | | | | | | | |
|---|---|---|---|---|---|---|---|---|---|---|---|---|---|
| | | Example | | | | | | | | | | Comparative Example | |
| | | 7 | 8 | 9 | 10 | 11 | 12 | 13 | 14 | 15 | 16 | 2 | 3 |
| Composition of colored image-forming layer | | | | | | | | | | | | | |
| Composite particles | (H) | 30 | 0 | 0 | 0 | 0 | 30 | 30 | 30 | 30 | 30 | 0 | 0 |
| | (I) | 0 | 30 | 0 | 0 | 0 | 0 | 0 | 0 | 0 | 0 | 0 | 0 |
| | (J) | 0 | 0 | 30 | 0 | 0 | 0 | 0 | 0 | 0 | 0 | 0 | 0 |
| | (K) | 0 | 0 | 0 | 30 | 0 | 0 | 0 | 0 | 0 | 0 | 0 | 0 |
| | (L) | 0 | 0 | 0 | 0 | 30 | 0 | 0 | 0 | 0 | 0 | 0 | 0 |
| | (M) | 0 | 0 | 0 | 0 | 0 | 0 | 0 | 0 | 0 | 0 | 30 | 0 |
| Black color-forming dye precursor | (a) | 0 | 0 | 0 | 0 | 0 | 0 | 0 | 0 | 0 | 0 | 0 | 5 |
| Red color-forming dye precursor | (a) | 8 | 8 | 8 | 8 | 8 | 0 | 0 | 8 | 8 | 8 | 8 | 0 |
| | (b) | 0 | 0 | 0 | 0 | 0 | 8 | 0 | 0 | 0 | 0 | 0 | 8 |
| | (c) | 0 | 0 | 0 | 0 | 0 | 0 | 8 | 0 | 0 | 0 | 0 | 0 |
| Color-developing agent | (a) | 25 | 25 | 25 | 25 | 25 | 25 | 25 | 0 | 0 | 0 | 25 | 25 |
| | (b) | 0 | 0 | 0 | 0 | 0 | 0 | 0 | 25 | 0 | 0 | 0 | 0 |
| | (c) | 0 | 0 | 0 | 0 | 0 | 0 | 0 | 0 | 25 | 0 | 0 | 0 |
| | (d) | 0 | 0 | 0 | 0 | 0 | 0 | 0 | 0 | 0 | 25 | 0 | 0 |
| Sensitizing agent | (a) | 10 | 10 | 10 | 10 | 10 | 10 | 10 | 10 | 10 | 10 | 10 | 10 |
| | (b) | 5 | 5 | 5 | 5 | 5 | 5 | 5 | 5 | 5 | 5 | 5 | 5 |
| Pigment | | 14 | 14 | 14 | 14 | 14 | 14 | 14 | 14 | 14 | 14 | 14 | 14 |
| Binder | | 3 | 3 | 3 | 3 | 3 | 3 | 3 | 3 | 3 | 3 | 3 | 3 |
| Lubricant | | 5 | 5 | 5 | 5 | 5 | 5 | 5 | 5 | 5 | 5 | 5 | 5 |
| Lower temperature-developed images | | 2 | 2 | 2 | 2 | 2 | 2 | 2 | 2 | 2 | 2 | 2 | 1 |
| Higher temperature-developed images | | 2 | 2 | 2 | 2 | 2 | 2 | 2 | 2 | 2 | 2 | 2 | 2 |
| Resistance to fogging (whiteness) | | 77 | 78 | 76 | 73 | 76 | 76 | 72 | 76 | 75 | 73 | 68 | 61 |

TABLE 3

| Item | | Example No. | | | | | | | | | | | | | |
|---|---|---|---|---|---|---|---|---|---|---|---|---|---|---|---|
| | | Example | | | | | | | | | | Comparative Example | | | |
| | | 17 | 18 | 19 | 20 | 21 | 22 | 23 | 24 | 25 | 26 | 4 | 5 | 6 | 7 |
| Composition of colored image-forming layer | | | | | | | | | | | | | | | |
| Composite particle | (H) | 30 | 30 | 30 | 30 | 30 | 30 | 30 | 30 | 30 | 30 | 0 | 0 | 0 | 0 |
| Black color-forming dye precursor | (a) | 0 | 0 | 0 | 0 | 0 | 0 | 0 | 0 | 0 | 0 | 5 | 5 | 5 | 5 |
| Orange color-forming dye precursor | (a) | 8 | 0 | 0 | 0 | 0 | 0 | 0 | 0 | 0 | 0 | 8 | 0 | 0 | 0 |
| | (b) | 0 | 8 | 0 | 0 | 0 | 0 | 0 | 0 | 0 | 0 | 0 | 0 | 0 | 0 |
| | (c) | 0 | 0 | 8 | 0 | 0 | 0 | 0 | 0 | 0 | 0 | 0 | 0 | 0 | 0 |
| | (d) | 0 | 0 | 0 | 8 | 0 | 0 | 0 | 0 | 0 | 0 | 0 | 0 | 0 | 0 |
| Reddish violet color forming | (a) | 0 | 0 | 0 | 0 | 8 | 0 | 0 | 0 | 0 | 0 | 0 | 8 | 0 | 0 |
| dye precursor | (b) | 0 | 0 | 0 | 0 | 0 | 8 | 0 | 0 | 0 | 0 | 0 | 0 | 0 | 0 |
| Blue color-forming dye precursor | (a) | 0 | 0 | 0 | 0 | 0 | 0 | 8 | 0 | 0 | 0 | 0 | 0 | 8 | 0 |
| | (b) | 0 | 0 | 0 | 0 | 0 | 0 | 0 | 8 | 0 | 0 | 0 | 0 | 0 | 0 |
| Green color-forming dye precursor | (a) | 0 | 0 | 0 | 0 | 0 | 0 | 0 | 0 | 8 | 0 | 0 | 0 | 0 | 8 |
| | (b) | 0 | 0 | 0 | 0 | 0 | 0 | 0 | 0 | 0 | 8 | 0 | 0 | 0 | 0 |
| Color-developing agent | (a) | 25 | 25 | 25 | 25 | 25 | 25 | 25 | 25 | 25 | 25 | 25 | 25 | 25 | 25 |
| Sensitizing agent | (a) | 10 | 10 | 10 | 10 | 10 | 10 | 10 | 10 | 10 | 10 | 10 | 10 | 10 | 10 |
| | (b) | 5 | 5 | 5 | 5 | 5 | 5 | 5 | 5 | 5 | 5 | 5 | 5 | 5 | 5 |
| Pigment | | 14 | 14 | 14 | 14 | 14 | 14 | 14 | 14 | 14 | 14 | 14 | 14 | 14 | 14 |

TABLE 3-continued

| Item | Example No. | | | | | | | | | | | | | |
|---|---|---|---|---|---|---|---|---|---|---|---|---|---|---|
| | Example | | | | | | | | | | Comparative Example | | | |
| | 17 | 18 | 19 | 20 | 21 | 22 | 23 | 24 | 25 | 26 | 4 | 5 | 6 | 7 |
| Binder | 3 | 3 | 3 | 3 | 3 | 3 | 3 | 3 | 3 | 3 | 3 | 3 | 3 | 3 |
| Lubricant | 5 | 5 | 5 | 5 | 5 | 5 | 5 | 5 | 5 | 5 | 5 | 5 | 5 | 5 |
| Lower temperature-developed images | 2 | 2 | 2 | 2 | 2 | 2 | 2 | 2 | 2 | 2 | 1 | 1 | 1 | 1 |
| Higher temperature-developed images | 2 | 2 | 2 | 2 | 2 | 2 | 2 | 2 | 2 | 2 | 2 | 2 | 2 | 2 |
| Resistance to fogging (whiteness) | 77 | 78 | 76 | 73 | 76 | 72 | 77 | 73 | 76 | 73 | 61 | 60 | 59 | 60 |

Tables 2 and 3 clearly show that in the colored image-forming layers of Examples 7 to 26, very clear two differently colored images were recorded without mixing of individual colors of the images, a color isolation of the differently colored images was very excellent, and the resistance to fogging was excellent, whereas in Comparative Example 2 in which the microcapsules (M) produced by the conventional method were used, the resultant colored image-forming layer exhibited a lower resistance to fogging than that of Examples 7 to 26, and in Comparative Examples 3 to 7 wherein no dye precursor-containing composite particles were employed, the lower temperature-developed colored images had a low color density and the resistance to fogging was bad.

Example 27

A thermosensitive recording material was produced by the same procedures as in Example 1 with the following exceptions.

An aqueous dispersion of dye-precursor-containing fine solid composite particles were prepared by dissolving 13 parts by weight of a black color-forming dye precursor consisting of 3-di-n-amylamino-6-methyl-7-anilinofluoran in 50 parts by weight of methylene chloride at a temperature of 20° C.; uniformly mixing and dissolving, in the resultant solution, 70 parts by weight of isocyanurate compound of hexamethylenediisocyanate (available under the trademark of Takenate D-170HN, from Takeda Yakuhinkogyo K.K., concentration: 100%) at a temperature of 20° C.; gradually adding the resultant mixture solution to 400 parts by weight of an aqueous solution of 10% by weight of polyvinyl alcohol (available under the trademark of Goselan L-3266, from Nihon Goseikagakukogyo K.K.) while agitating the mixture in a homogenizer at a rotation of 10,000 rpm at a temperature of 20° C. to emulsify the mixture solution; homogenizing the resultant emulsion by adding 100 parts by weight of water thereto at a temperature of 20° C.; heating the aqueous emulsion at a temperature of 45° C. for 5 hours while continuing the agitation to completely evaporate methylene chloride from the emulsion; and polymerizing the polyvalent isocyanate compound in the remaining emulsion by heating the remaining emulsion to a temperature of 85° C. over a time of 30 minutes and maintaining this temperature for 3 hours. The resultant aqueous dispersion contained black color-forming fine solid composite particles (N) having an average size of 1.8 $\mu$m.

The composite particles (N) were subjected to an electron microscopic observation by the same procedures as in Example 1.

Figure 2:
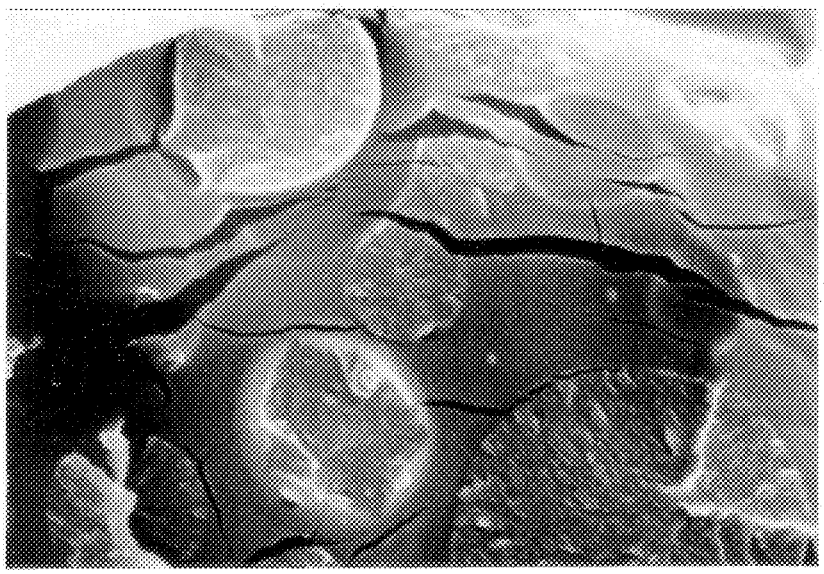
FIG. 2 is an electron microscope cross-sectional view of dye precursor-containing fine solid composite particles of Example 27 in accordance with the present invention.

FIG. 2 shows an electron microscopic view of cross-sections of the composite particles (N) which are dense particles having substantially no pores.

In the undercoating, the resultant undercoat layer was in a dry solid weight of 8.0 g/m$^2$.

Also, the thermosensitive colored image-forming layer was in a dry solid weight of 6.0 g/m$^2$.

The test results are shown in Table 4.

Comparative Example 8

A thermosensitive recording material was produced and tested by the same procedures as in Example 27 with the following exceptions.

In the preparation of the dye precursor-containing fine solid composite particles, the polyvalent isocyanate compound consisted of an adduct of trimethylolpropane with xylenediisocyanate in a molar ratio of 1:3 which was available under the trademark of Takenate D-110N from Takeda Yakuhinkogyo K.K., and in the state of a dilution with ethyl acetate and had a concentration of 75% by weight; and the evaporation procedure for methylene chloride was omitted. The resultant dispersion contained microcapsules (O) having an average particle size of 4.2 $\mu$m.

Figure 3:
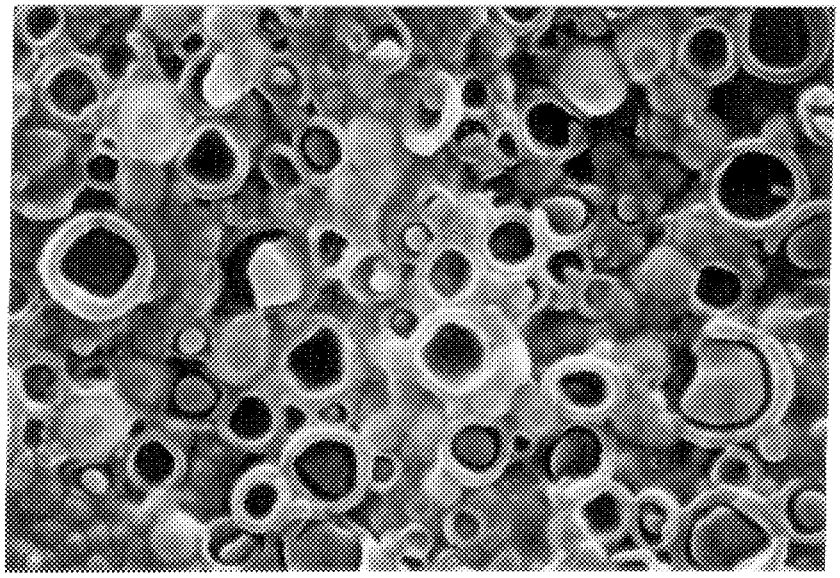
Fig.3 (PRIOR ART)
FIG. 3 is an electron microscope cross-sectional view of dye precursor-containing microcapsules of Comparative Example 8.

FIG. 3 shows an electron microscopic view of the cross-sections of microcapsules (O) which have hollow cores surrounded by shells.

The test results are shown in Table 4.

TABLE 4

| Item | Example No. | |
|---|---|---|
| | Example 27 | Comparative Example 8 |
| Composition of colored image-forming layer | | |
| Composite particles (N) | 30 | |
| Microcapsules (O) | | 30 |
| Color-developing agent (a) | 35 | 35 |
| Sensitizing agent (a) | 10 | 10 |
| Pigment | 15 | 15 |
| Binder | 5 | 5 |
| Lubricant | 5 | 5 |
| Whiteness | | |
| Before calendering | 77.8 | 77.5 |
| After calendering | 75.5 | 72.1 |
| Color density | | |
| Before storage test | 1.20 | 1.11 |
| After storage test | 1.01 | 0.70 |
| Whiteness after storage test | 70.8 | 59.5 |

Examples 28 to 47 and Comparative Examples 9 to 14

In each of Examples 28 to 47 and Comparative Examples 9 to 14, a thermosensitive multi-colored image-recording material was produced by the following procedures.

Preparation of dye-precursor-containing fine solid composite particles (P) to (U) Composite particles (P)

A black color-forming dye precursor consisting of 3-di (n-amylamino)-6-methyl-7-anilinofluoran in an amount of 6 parts by weight was dissolved in 30 parts by weight of methylene chloride. The resultant solution was uniformly mixed with 12 parts by weight of an adduct of trimethylpropane with xylylenediisocyanate in a molar ratio of 1:3 (Takenate D-110N) in the state of an dilution with ethyl acetate and having a concentration of 75% by weight, to provide a solution.

The solution was gradually added to 250 parts by weight of an aqueous solution of 5% by weight of polyvinyl alcohol (Gosenol GM-14L), while emulsifying the resultant mixture in a homogenizer at 5000 rpm. The resultant emulsion was homogenized by adding thereto 100 parts by weight of water.

The emulsion was heated at a temperature of 45° C. for 5 hours while stirring, to completely evaporate away methylene chloride and ethyl acetate from the emulsion. The remaining emulsion was heated to 80° C. and maintained at this temperature for 3 hours to polymerize the polyvalent isocyanate compound.

The resultant aqueous dispersion contained black color-forming dye precursor-containing fine solid composite particles (P) having an average particle size of 1.8 μm.

Composite particles (Q)

A composite particle (Q)-containing aqueous dispersion was prepared by the same procedures as of the composite particle (P) except that in the preparation of the dye precursor-containing solution, the adduct of trimethylolpropane with xylylenediisocyanate in a molar ratio of 1:3 (Takenate D-110N) was employed in an amount of 10 parts by weight, and after the emulsification step, 2 parts of an adduct of ethylenediamine with ethyleneoxide were added to the emulsion.

The resultant aqueous dispersion contained black color-forming dye precursor-containing fine solid composite particles (Q) with an average particle size of 1.8 μm.

Composite particles (R)

A composite particle (R)-containing aqueous dispersion was prepared by the same procedures as of the composite particle (P) except that in the preparation of the dye precursor-containing solution, the adduct of trimethylolpropane with xylylenediisocyanate in a molar ratio of 1:3 (Takenate D-110N) was employed in an amount of 6 parts by weight together with 6 parts by weight of an adduct of trimethylolpropane with hexamethylenediisocyanate in a molar ratio of 1:3 which was available under the trademark of Takenate D-160N, from Takeda Yakuhinkogyo K.K., and diluted in a concentration of 75% by weight with ethyl acetate; and in the polymerization step, the polymerization was carried out at a temperature of 90° C.

The resultant aqueous dispersion contained black color-forming dye precursor-containing fine solid composite particles (R) with an average particle size of 2.1 μm.

Composite particles (S)

A composite particle (S)-containing aqueous dispersion was prepared by the same procedures as of the composite particle (P) except that in the preparation of the dye precursor-containing solution the 3-di(n-amylamino)-6-methyl-7-anilinofluoran was employed in an amount of 4 parts by weight, together with 2 parts by weight of an ultraviolet ray-absorbing agent consisting of 2-(2-hydroxy-5-methylphenyl)-2H-benzatriazole (trademark: Tinubin P, made by Ciba-Geigy).

The resultant aqueous dispersion contained black color-forming dye precursor-containing fine solid composite particles (S) with an average particle size of 2.2 μm.

Composite particles (T)

A composite particle (T)-containing aqueous dispersion was prepared by the same procedures as of the composite particle (P) except that in the preparation of the dye precursor-containing solution, the adduct of trimethylolpropane with xylylenediisocyanate in a molar ratio of 1:3 (Takenate D-110N) was employed in an amount of 20 parts by weight.

The resultant aqueous dispersion contained black color-forming dye precursor-containing fine solid composite particles (T) with an average particle size of 2.2 μm.

Microcapsules (U) (Comparative)

A microcapsule (U)-containing aqueous dispersion was prepared by the same procedures as of the composite particle (P) except that the evaporation step for methylene chloride and ethyl acetate was omitted, and the emulsion homogenized by the addition of water was directly subjected to the polymerization step at a temperature of 80° C.

The resultant aqueous dispersion contained black color-forming dye precursor-containing microcapsules (U) with an average particle size of 2.8 μm. The composite particles (O) to (T) and the microcapsule (U) are in a substantially spherical form in an electron microscope view.

In the production of thermosensitive multi-colored image-recording materials, the same chemicals as in Example 7 were employed.

Preparation of aqueous dispersions of the second dye precursors, the color-developing agents and the sensitizing agents Each of the second dye precursors, the color-developing agents and sensitizing agents were dispersed in an aqueous medium in the following composition to provide an aqueous dispersion.

Composition

| Component | Part by weight |
|---|---|
| A second dye precursor, color-developing agent or sensitizing agent | 40 |
| 10% aqueous polyvinyl alcohol solution $(*)_2$ | 20 |

Note:

Degree of polymerization: 500

Degree of saponification: 90%

The mixture was ground and dispersed in a vertical type sand mill (Sand Grinder made by Aymex K.K.) into an average particle size of 1.2 μm.

Preparation of a pigment dispersion

An aqueous pigment dispersion was prepared by mixing silica (Mizukasil P527) having an oil absorption of 190 ml/100 g with a 0.7% aqueous polyacrylic acid sodium salt solution in the following composition, and the mixture was subjected to a dispersion procedure using a Cowless disperser.

| Component | Part by weight |
|---|---|
| Silica | 30 |
| 7% aqueous polyacrylic acid Na-salt | 70 |

Separately, a binder solution consisting of an aqueous solution of 10% by solid weight of polyvinyl alcohol (Gosenol NM11Q) and a lubricant dispersion consisting of an aqueous dispersion of 21% by solid weight of zinc stearate (Z-7) were prepared.

Undercoating

In each of Examples 28 to 47 and Comparative Examples 9 to 14, the aqueous pigment dispersion and the binder solution was mixed in a solid weight mixing ratio of 85:15 to provide a undercoating liquid. This undercoating liquid was coated in an amount corresponding to a dry solid weight of 5.0 g/m$^2$ on a surface of a neutral wood-free paper sheet with a basis weight of 60 g/m$^2$ by using a Mayer bar, and dried to form an undercoat layer.

Production of a thermosensitive two differently colored image-recording material A coating liquid for a thermosensitive two differently colored image forming layer was prepared by mixing the fine solid composite particle dispersion, and the second dye precursor dispersion as shown in Tables 5 and 6, the color-developing agent dispersion, the sensitizing agent dispersion, the pigment dispersion, the binder solution and the lubricant dispersion were mixed altogether in the solid weight mixing ratio shown in Tables 5 and 6. The resultant coating liquid was coated in an amount corresponding to a dry solid weight of 5.0 g/m$^2$ on the undercoat layer on the support by using a mayer bar, and dried to form a thermosensitive multi-colored image-forming layer. The resultant a thermosensitive multi-colored image recording material was surface-treated by a super calender to smooth the surface of the colored image-forming layer into a Bekk smoothness of 100 to 150 seconds determined in accordance with JIS P8119. The test for the thermosensitive recording material was carried out by the same methods as in Example 7. The test results are shown in Tables 5 and 6.

TABLE 5

| | | Example No. | | | | | | | | | | | |
|---|---|---|---|---|---|---|---|---|---|---|---|---|---|
| | | Example | | | | | | | | | | Comparative Example | |
| Item | | 28 | 29 | 30 | 31 | 32 | 33 | 34 | 35 | 36 | 37 | 9 | 10 |
| Composition of colored image-forming layer | | | | | | | | | | | | | |
| Composite particles | (P) | 30 | 0 | 0 | 0 | 0 | 0 | 0 | 0 | 0 | 0 | 0 | 0 |
| | (Q) | 0 | 30 | 0 | 0 | 0 | 0 | 0 | 0 | 0 | 0 | 0 | 0 |
| | (R) | 0 | 0 | 30 | 0 | 0 | 0 | 0 | 0 | 0 | 0 | 0 | 0 |
| | (S) | 0 | 0 | 0 | 30 | 0 | 30 | 30 | 30 | 30 | 30 | 0 | 0 |
| | (T) | 0 | 0 | 0 | 0 | 30 | 0 | 0 | 0 | 0 | 0 | 0 | 0 |
| | (U) | 0 | 0 | 0 | 0 | 0 | 0 | 0 | 0 | 0 | 0 | 30 | 0 |
| Black color-forming dye precursor | (a) | 0 | 0 | 0 | 0 | 0 | 0 | 0 | 0 | 0 | 0 | 0 | 6 |
| Red color-forming dye precursor | (a) | 8 | 8 | 8 | 8 | 8 | 0 | 0 | 8 | 8 | 8 | 8 | 8 |
| | (b) | 0 | 0 | 0 | 0 | 0 | 8 | 0 | 0 | 0 | 0 | 0 | 0 |
| | (c) | 0 | 0 | 0 | 0 | 0 | 0 | 8 | 0 | 0 | 0 | 0 | 0 |
| Color-developing agent | (a) | 25 | 25 | 25 | 25 | 25 | 25 | 25 | 0 | 0 | 0 | 25 | 25 |
| | (b) | 0 | 0 | 0 | 0 | 0 | 0 | 0 | 25 | 0 | 0 | 0 | 0 |
| | (c) | 0 | 0 | 0 | 0 | 0 | 0 | 0 | 0 | 25 | 0 | 0 | 0 |
| | (d) | 0 | 0 | 0 | 0 | 0 | 0 | 0 | 0 | 0 | 25 | 0 | 0 |
| Sensitizing agent | (a) | 10 | 10 | 10 | 10 | 10 | 10 | 10 | 10 | 10 | 10 | 10 | 10 |
| | (b) | 5 | 5 | 5 | 5 | 5 | 5 | 5 | 5 | 5 | 5 | 5 | 5 |
| Pigment | | 14 | 14 | 14 | 14 | 14 | 14 | 14 | 14 | 14 | 14 | 14 | 31 |
| Binder | | 3 | 3 | 3 | 3 | 3 | 3 | 3 | 3 | 3 | 3 | 3 | 10 |
| Lubricant | | 5 | 5 | 5 | 5 | 5 | 5 | 5 | 5 | 5 | 5 | 5 | 5 |
| Lower temperature-developed images | | 2 | 2 | 2 | 2 | 2 | 2 | 2 | 2 | 2 | 2 | 2 | 1 |
| Higher temperature-developed images | | 2 | 2 | 2 | 2 | 2 | 2 | 2 | 2 | 2 | 2 | 2 | 2 |
| Resistance to fogging (whiteness) | | 76 | 77 | 77 | 78 | 77 | 76 | 73 | 76 | 77 | 72 | 68 | 65 |

TABLE 6

| | | Example No. | | | | | | | | | | | | | |
|---|---|---|---|---|---|---|---|---|---|---|---|---|---|---|---|
| | | Example | | | | | | | | | | Comparative Example | | | |
| Item | | 38 | 39 | 40 | 41 | 42 | 43 | 44 | 45 | 46 | 47 | 11 | 12 | 13 | 14 |
| Composition of colored image-forming layer | | | | | | | | | | | | | | | |
| Composite particle | (S) | 30 | 30 | 30 | 30 | 30 | 30 | 30 | 30 | 30 | 30 | 0 | 0 | 0 | 0 |
| Black color-forming dye precursor | (a) | 0 | 0 | 0 | 0 | 0 | 0 | 0 | 0 | 0 | 0 | 6 | 6 | 6 | 6 |
| Orange color-forming dye precursor | (a) | 8 | 0 | 0 | 0 | 0 | 0 | 0 | 0 | 0 | 0 | 8 | 0 | 0 | 0 |
| | (b) | 0 | 8 | 0 | 0 | 0 | 0 | 0 | 0 | 0 | 0 | 0 | 0 | 0 | 0 |
| | (c) | 0 | 0 | 8 | 0 | 0 | 0 | 0 | 0 | 0 | 0 | 0 | 0 | 0 | 0 |
| | (d) | 0 | 0 | 0 | 8 | 0 | 0 | 0 | 0 | 0 | 0 | 0 | 0 | 0 | 0 |
| Reddish violet color forming- | (a) | 0 | 0 | 0 | 0 | 8 | 0 | 0 | 0 | 0 | 0 | 0 | 8 | 0 | 0 |
| dye precursor | (b) | 0 | 0 | 0 | 0 | 0 | 8 | 0 | 0 | 0 | 0 | 0 | 0 | 0 | 0 |
| Blue color-forming dye precursor | (a) | 0 | 0 | 0 | 0 | 0 | 0 | 8 | 0 | 0 | 0 | 0 | 0 | 8 | 0 |
| | (b) | 0 | 0 | 0 | 0 | 0 | 0 | 0 | 8 | 0 | 0 | 0 | 0 | 0 | 0 |
| Green color-forming dye precursor | (a) | 0 | 0 | 0 | 0 | 0 | 0 | 0 | 0 | 8 | 0 | 0 | 0 | 0 | 8 |
| | (b) | 0 | 0 | 0 | 0 | 0 | 0 | 0 | 0 | 0 | 8 | 0 | 0 | 0 | 0 |
| Color-developing agent | (a) | 25 | 25 | 25 | 25 | 25 | 25 | 25 | 25 | 25 | 25 | 25 | 25 | 25 | 25 |

TABLE 6-continued

| Item | | Example No. | | | | | | | | | | | | | |
|---|---|---|---|---|---|---|---|---|---|---|---|---|---|---|---|
| | | Example | | | | | | | | | | Comparative Example | | | |
| | | 38 | 39 | 40 | 41 | 42 | 43 | 44 | 45 | 46 | 47 | 11 | 12 | 13 | 14 |
| Sensitizing agent | (a) | 10 | 10 | 10 | 10 | 10 | 10 | 10 | 10 | 10 | 10 | 10 | 10 | 10 | 10 |
| | (b) | 5 | 5 | 5 | 5 | 5 | 5 | 5 | 5 | 5 | 5 | 5 | 5 | 5 | 5 |
| Pigment | | 14 | 14 | 14 | 14 | 14 | 14 | 14 | 14 | 14 | 14 | 31 | 31 | 31 | 31 |
| Binder | | 3 | 3 | 3 | 3 | 3 | 3 | 3 | 3 | 3 | 3 | 10 | 10 | 10 | 10 |
| Lubricant | | 5 | 5 | 5 | 5 | 5 | 5 | 5 | 5 | 5 | 5 | 5 | 5 | 5 | 5 |
| Lower temperature-developed images | | 2 | 2 | 2 | 2 | 2 | 2 | 2 | 2 | 2 | 2 | 1 | 1 | 1 | 1 |
| Higher temperature-developed images | | 2 | 2 | 2 | 2 | 2 | 2 | 2 | 2 | 2 | 2 | 2 | 2 | 2 | 2 |
| Resistance to fogging (whiteness) | | 76 | 75 | 77 | 74 | 76 | 73 | 76 | 72 | 77 | 73 | 66 | 63 | 64 | 65 |

Tables 5 and 6 clearly show that the thermosensitive multi-colored image-recording materials of Examples 28 to 47 can form multi-colored images having an excellent color isolation of the individual colors without mixing of the desired individual colors and exhibit an excellent resistance to fogging.

We claim:

1. A thermosensitive recording material comprising:

a support, and a thermosensitive colored image-forming layer formed on a surface of the support and comprising at least one substantially colorless dye precursor, a color-developing agent reactive with the dye precursor upon heating to thereby develop a color, and a binder, the dye precursor in the thermosensitive colored image-forming layer being present in a plurality of fine solid composite particles which have been prepared by dissolving a solute comprising the dye precursor in a solvent comprising a polymerization component comprising a polyvalent isocyanate compound; emulsifying the resultant solution in an aqueous medium; and subjecting the resultant aqueous emulsion to a polymerization reaction of the polymerization component; and in which the dye precursor is dissolved in a solid thermoplastic resinous matrix consisting of a resultant polyurea or polyurethane polyurea resin.

2. The thermosensitive recording material as claimed in claim 1, wherein the dye precursor-containing fine composite particles have an average particle size of 0.1 or 15 $\mu$m.

3. The thermosensitive recording material as claimed in claim 1, wherein the solute further contains at least one fusible organic compound and thus the fusible organic compound is contained together with the dye precursor in the solid thermoplastic resinous matrix of the fine composite particles.

4. The thermosensitive recording material as claimed in claim 3, wherein the organic compound is selected from the group consisting of thermosensitizing compounds, UV-ray-absorbing compounds and antioxidant compounds.

5. The thermosensitive recording material as claimed in claim 1, wherein the polymerization component comprises at least one member selected from polyvalent isocyanate compounds, mixtures and addition reaction products of polyvalent isocyanate compounds with polyols, and biuret compounds and isocyanurate compounds of polyvalent isocyanate compounds.

6. The thermosensitive recording material as claimed in claim 1, wherein the polymerization component comprises at least one member selected from the group consisting of hexamethylene diisocyanate, addition reaction products of hexamethylene diisocyanate with trimethylolpropane, biuret compounds of hexamethylene diisocyanate, isocyanurate compounds of hexamethylene diisocyanate, dicyclohexylmethane-4,4'-diisocyanate, 5-isocyanato-1-(isocyanatomethyl)-1,3,3,-trimethylcyclohexane, tetramethylxylene diisocyanate and 1,3-bis(isocyanatomethyl) cyclohexane.

7. The thermosensitive recording material as claimed in claim 1, wherein the solute is dissolved in the solvent at a temperature of 60° C. to 200° C.

8. The thermosensitive recording material as claimed in claim 1, wherein the dye precursor-containing fine composite particles are non-porous dense particles, porous particles, or hollow particles.

9. The thermosensitive recording material as claimed in claim 1, wherein the dye precursor is present in an amount of 5 to 80% by weight based on the total weight of the fine composite particles.

10. The thermosensitive recording material as claimed in claim 1, wherein the solvent consists of the polymerization component alone.

11. The thermosensitive recording material as claimed in claim 1, wherein the solvent comprises, in addition to the polymerization component, a non-reactive, hydrophobic liquid substance having a boiling temperature of 20° to 100° C., and the resultant aqueous emulsion is heat-treated at a temperature of 20° to 55° C. to evaporate away the liquid substance from the aqueous emulsion, before the polymerization reaction.

12. The thermosensitive recording material as claimed in claim 11, wherein the non-reactive, hydrophobic liquid substance comprises at least one member selected from the group consisting of butyl chloride, ethylidene chloride, propyl chloride, methylene chloride, ethyl acetate, methyl acetate.

13. The thermosensitive recording material as claimed in claim 1, wherein the aqueous medium contains an emulsifying agent comprising at least one member selected from the group consisting of polyacrylamide, polyvinyl pyrrolidone, polyvinyl alcohol, sulfonyl group-modified polyvinyl alcohol, methyl cellulose, water-soluble styrene-maleic anhydride copolymers, and water-soluble derivatives of the above-mentioned polymers.

14. The thermosensitive recording material as claimed in claim 13, wherein the emulsifying agent is used in an amount of 1 to 50% by weight based on the total weight of the resultant fine composite particles.

15. The thermosensitive recording material as claimed in claim 1, wherein the thermosensitive colored image-forming layer contains, in addition to the color-developing agent and the binder, a plurality of fine solid composite particles having a first dye precursor solid dissolved in the thermoplastic resinous matrix, and a plurality of fine solid particles of a second dye precursor different in developed color from the first dye precursor, and thus colored images can be formed in two different colors in the thermosensitive colored image-forming layer.

16. The thermosensitive recording material as claimed in claim 15, wherein the first dye precursor is capable of forming a black color.

17. The thermosensitive recording material as claimed in claim 1, wherein the thermosensitive colored image-forming layer contains, in addition to the color-developing agent and the binder, a plurality of first fine solid composite particles having a first dye precursor solid dissolved in a first thermoplastic resinous matrix thereof, and a plurality of second fine solid composite particles having a second dye precursor solid-dissolved in a second thermoplastic resinous matrix thereof and different in developed color from the first dye precursor, the first and second fine solid composite particles being different in color-forming temperature from each other, and thus colored images in two different colors can be formed in the thermosensitive colored image-forming layer.

18. The thermosensitive recording material as claimed in claim 17, wherein the thermosensitive colored image layer comprises in addition to the color-developing agent, and the binder, first fine solid composite particles having the first dye precursor and second fine solid composite particles having the second dye precursor, a plurality of fine solid particles of a third dye precursor different in developed color from the first and second dye precursors, and thus is capable of recording therein colored images in three different colors.

19. The thermosensitive recording material as claimed in claim 1, having a first thermosensitive colored image-forming layer comprising a plurality of fine solid composite particles having a first dye precursor solid-dissolved in the thermoplastic resinous matrix, in addition to the color-developing agent and the binder, and formed on the support; and a second thermosensitive colored image-forming layer formed on the first layer or between the support and the first layer, and comprising a plurality of fine solid particles of a second dye precursor different in developed color from the first dye precursor, the color-developing agent and the binder, thereby the recording material being capable of recording therein colored images in two different colors.

20. The thermosensitive recording material as claimed in claim 19, wherein the first thermosensitive colored image-forming layer further comprises a plurality of fine solid particles of a third dye precursor different in developed color from the first and second dye precursor and thereby the recording material is capable of recording colored images in three different colors.

21. The thermosensitive recording material as claimed in claim 1, having a first thermosensitive colored image-forming layer formed on the support and comprising a plurality of first fine solid composite particles having a first dye precursor solid-dissolved in a first thermoplastic resinous matrix thereof, and a plurality of fine solid particles of a second dye precursor different in developed color from the first dye precursor, in addition to the color-developing agent and the binder, and a second thermosensitive colored image-forming layer located on the first layer or between the first layer and the support and comprising a plurality of second fine solid composite particles having a third dye precursor solid-dissolved in a second thermoplastic resinous matrix thereof, and different in developed color from the first and second dye precursor, the first and second fine solid composite particles being different in color-forming temperature from each other, and thereby the recording material being capable of recording colored images in three different colors.

* * * * *